US010948134B2

(12) United States Patent
TeRoller

(10) Patent No.: US 10,948,134 B2
(45) Date of Patent: Mar. 16, 2021

(54) LED LIGHT ASSEMBLY WITH INTEGRATED HEAT SINK AND RADIALLY DISPOSED LIGHT EMITTERS EMITTING LIGHT BELOW A HORIZON

(71) Applicant: G.T. Solutions, L.L.C., Middleville, MI (US)

(72) Inventor: Jeff TeRoller, Middleville, MI (US)

(73) Assignee: G.T. Solutions, LLC, Holland, MI (US)

( * ) Notice: Subject to any disclaimer, the term of this patent is extended or adjusted under 35 U.S.C. 154(b) by 0 days.

(21) Appl. No.: 16/566,425

(22) Filed: Sep. 10, 2019

(65) Prior Publication Data

US 2020/0080691 A1 Mar. 12, 2020

Related U.S. Application Data

(60) Provisional application No. 62/729,022, filed on Sep. 10, 2018.

(51) Int. Cl.

| | |
|---|---|
| ***F21K 9/23*** | (2016.01) |
| ***F21V 29/77*** | (2015.01) |
| ***F21V 23/04*** | (2006.01) |
| ***F21V 23/00*** | (2015.01) |
| *F21Y 113/13* | (2016.01) |
| *F21Y 115/10* | (2016.01) |

(52) U.S. Cl.

CPC ..... *F21K 9/23* (2016.08); *F21V 23/009* (2013.01); *F21V 23/0435* (2013.01); *F21V 29/773* (2015.01); *F21Y 2113/13* (2016.08); *F21Y 2115/10* (2016.08)

(58) Field of Classification Search

CPC . F21K 9/23; F21K 9/232; F21K 9/235; F21Y 2115/10

See application file for complete search history.

(56) References Cited

U.S. PATENT DOCUMENTS

| | | | | |
|---|---|---|---|---|
| 7,521,872 | B2 * | 4/2009 | Bruning | H05B 45/22 315/158 |
| 7,909,481 | B1 * | 3/2011 | Zhang | F21K 9/232 362/249.02 |
| 9,435,497 | B2 * | 9/2016 | Kallas | F21V 29/50 |
| 2006/0238136 | A1 * | 10/2006 | Johnson, III | H05B 35/00 315/185 R |
| 2007/0014549 | A1 * | 1/2007 | Demarest | H05B 41/282 392/393 |

FOREIGN PATENT DOCUMENTS

WO WO-2012139845 A1 * 10/2012 ..... F21V 29/83

OTHER PUBLICATIONS

Machine Translation WO2012139845 (Year: 2012).*

* cited by examiner

*Primary Examiner* — Robert J May

(74) *Attorney, Agent, or Firm* — Varnum LLP

(57) ABSTRACT

A LED lighting assembly is provided having a housing having a top portion and an opposed base, a plurality of lighting elements connected to and positioned radially around the assembly, at least one of the plurality of lighting elements connected to an integral heat sink wherein each of the plurality of lighting elements positioned adjacent to an optic, the optic configured to control the direction of the light such that it directs the light below horizon to improve the area lighting efficiency. The LED lighting assembly may be controlled remotely or by mesh operations as herein described.

21 Claims, 22 Drawing Sheets

LED LIGHT ASSEMBLY WITH INTEGRATED HEAT SINK AND RADIALLY DISPOSED LIGHT EMITTERS EMITTING LIGHT BELOW A HORIZON

CROSS REFERENCE TO RELATED APPLICATIONS

The application claims priority and benefit to U.S. provisional application Ser. No. 62/729,022 filed on Sep. 10, 2018 which is incorporated herein by reference.

TECHNICAL FIELD

The present invention relates to the field of LED lighting and more specifically to LED lighting for use within decorative lighting fixtures.

BACKGROUND

Street, parking lot, park, campus, and sidewalk lighting in certain areas, such as downtown and other urban areas, commonly feature decorative lighting or lighting fixtures. The lighting fixtures may incorporate decorative components such as translucent globes to diffuse and disperse the light.

Traditionally, high intensity discharge (HID) and incandescent light bulbs (hereinafter "traditional" lighting or light bulbs or bulbs) were used as lighting elements within the decorative fixtures. In some cases, the fixtures or translucent globes would include diffusing elements that were shaped and sized to correspond to the shape or size of the traditional bulbs.

In recent years, traditional lighting elements have been replaced by LED lighting elements. The LED lighting elements provide power reduction and other advantages over traditional bulbs, but current designs suffer from numerous drawbacks.

First, current designs fail to optimize lighting angles of the LED lights. The resulting light can cause increased glare and fail to provide useful for pedestrians and drivers.

Second, current LED lighting designs lack an optimized design that maximizes lighting of intended areas of illuminance while minimizing power consumption and heat.

Finally, current designs provide only fixed solutions and fail to provide any meaningful control to users or designers of street and walkway lighting areas.

Accordingly, an improved LED lighting assembly is needed.

SUMMARY

An LED lighting assembly is provided having a housing having a top portion and an opposed base, a plurality of lighting elements connected to and positioned radially around the assembly, at least one of the plurality of lighting elements connected to an integral heat sink wherein each of the plurality of lighting elements positioned adjacent to an optic, the optic configured to control the direction of the light such that it directs the light below horizon to improve the area lighting efficiency.

In some embodiments, the assembly includes a screw base so as to easily retrofit with existing lamp structures and in other embodiments an auxiliary base is provided to connect to an existing lamp structure to accommodate the LED lighting assembly. In some embodiments, each of the plurality of lighting elements is an LED. Further, a processor may be provided in connection with the assembly in communication with a control device. In some embodiments, each of the plurality of lighting elements is independently controlled by the control device and the processor so as to enable a user to control only a portion of the plurality of lighting elements. In other embodiments, each of the plurality of lighting elements is controlled in subsets or groups of the larger population of the plurality of lighting elements by the control device and the processor so as to enable a user to control all or a portion of the plurality of lighting elements. Software may be provided on the processor wherein the lighting assembly is configured to be updatable remotely. In some embodiments, the control device is a computer. In other embodiments, the control device is a mobile device. The RGB or RGB may provide a notification signal to provide warnings, police situations or other similar notifications.

The optic may be configured so as to direct light from the plurality of lighting elements in a downward direction with peak intensity in the 10 degrees below horizon to 40 degrees below horizon range.

An uplight subassembly may be provided wherein an uplight subassembly may be controlled remotely. The uplight subassembly may include RGB or RGBW capability so as to illuminate a portion of the surrounding fixture with color.

The LED lighting assembly may be in communication with at least a second LED lighting assembly. Alternatively, the LED lighting assembly may be in communication with a central external control device.

In some embodiments, a removable and or replaceable cap subassembly is provided so as to enable a user to update and or change hardware. In other embodiments, a photocell receptacle is connected to and communicates with the LED lighting assembly to enable external control.

Device control or updates may be accomplished automatically when the control device equipment passes within the communication distance of a Bluetooth radio to the LED lighting assembly.

These and additional features provided by the embodiments described herein will be more fully understood in view of the following detailed description, in conjunction with the drawings.

BRIEF DESCRIPTION OF THE DRAWINGS

The operation of the invention may be better understood by reference to the detailed description taken in connection with the following illustrations, wherein.

DETAILED DESCRIPTION

Figure 1:
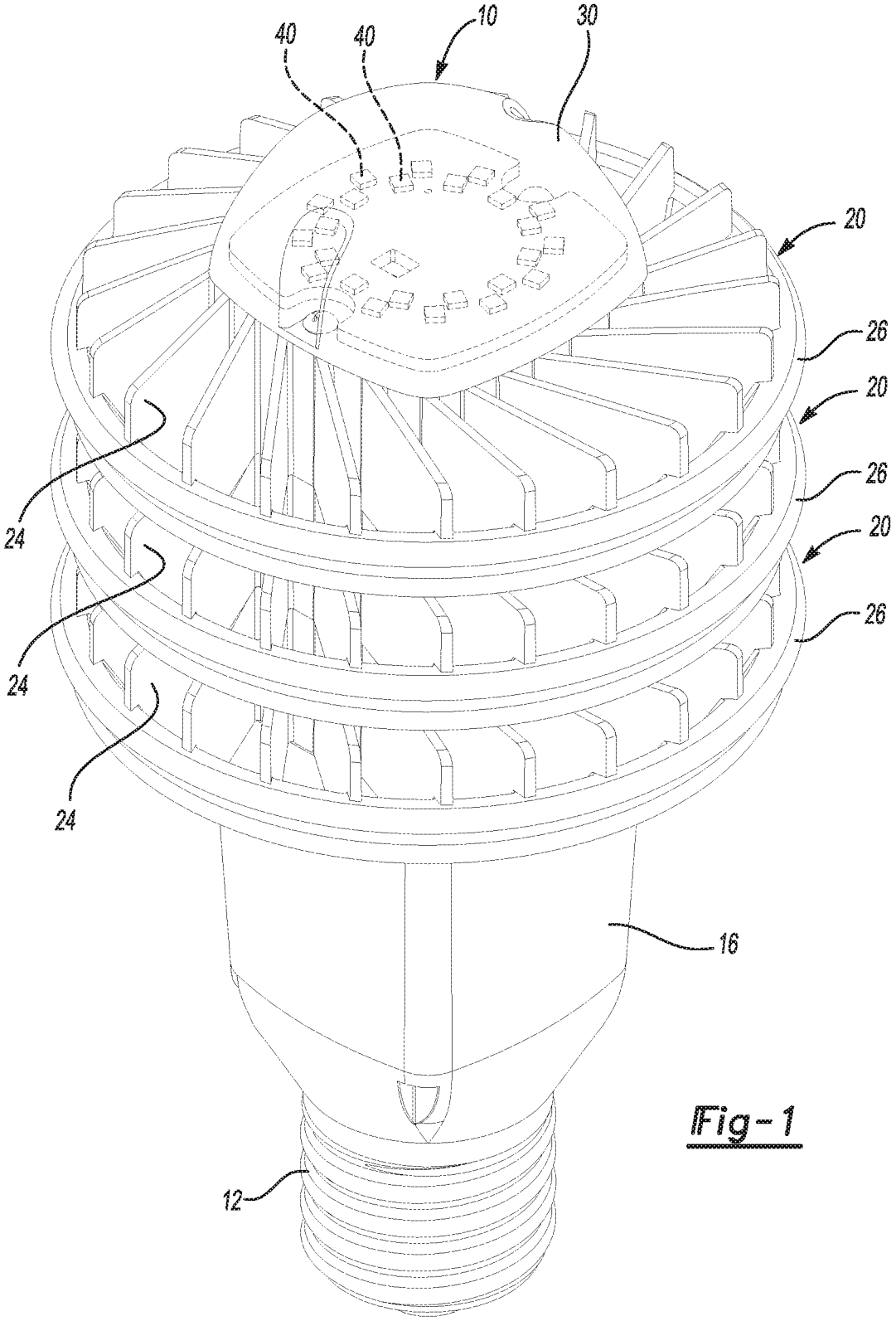
FIG. 1 illustrates a top perspective view of one embodiment of a LED light assembly according to one or more embodiments shown and described herein.
Figure 2:
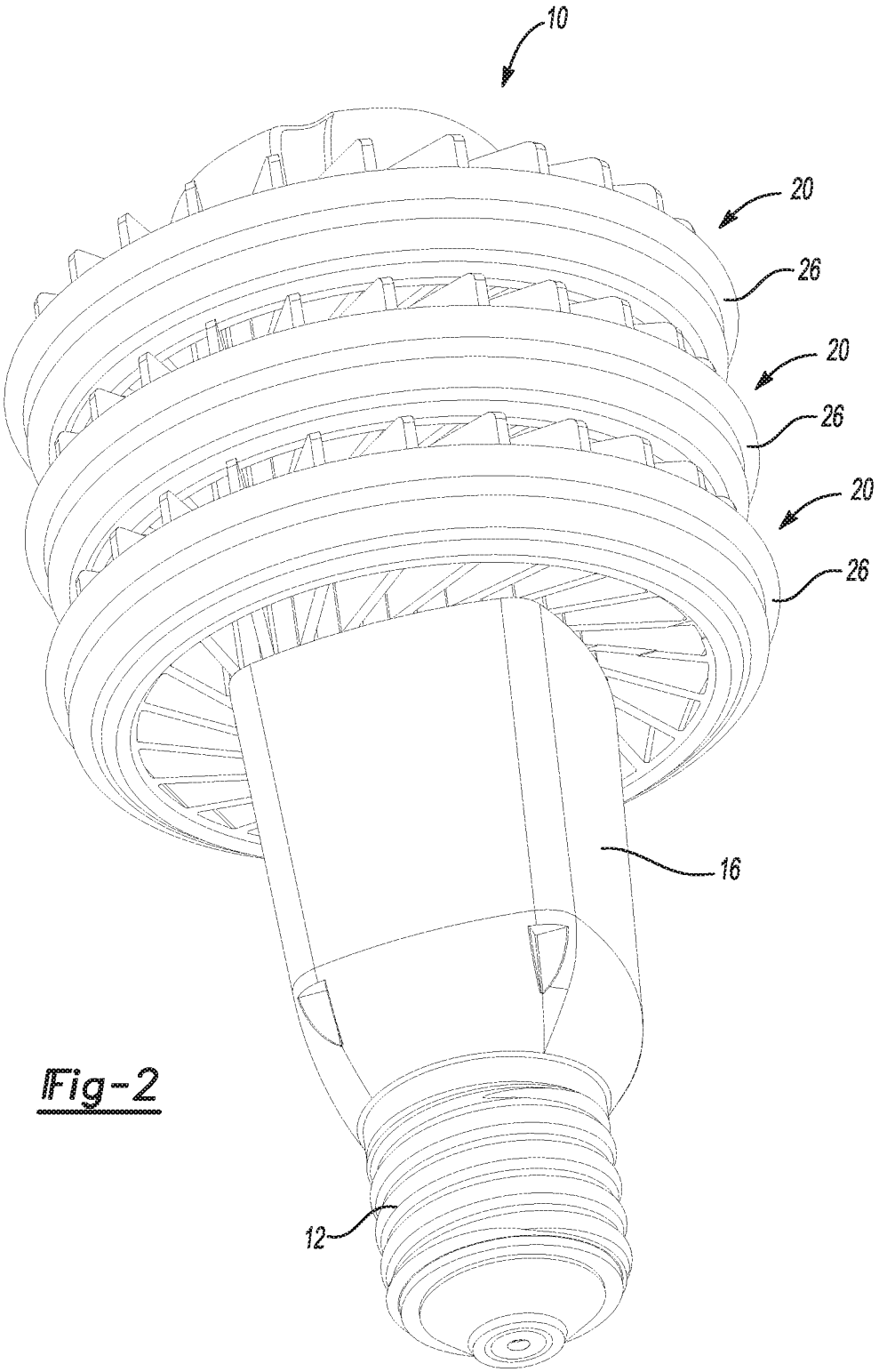
FIG. 2 illustrates a bottom perspective view of one embodiment of a LED light assembly according to one or more embodiments shown and described herein.
Figure 4:
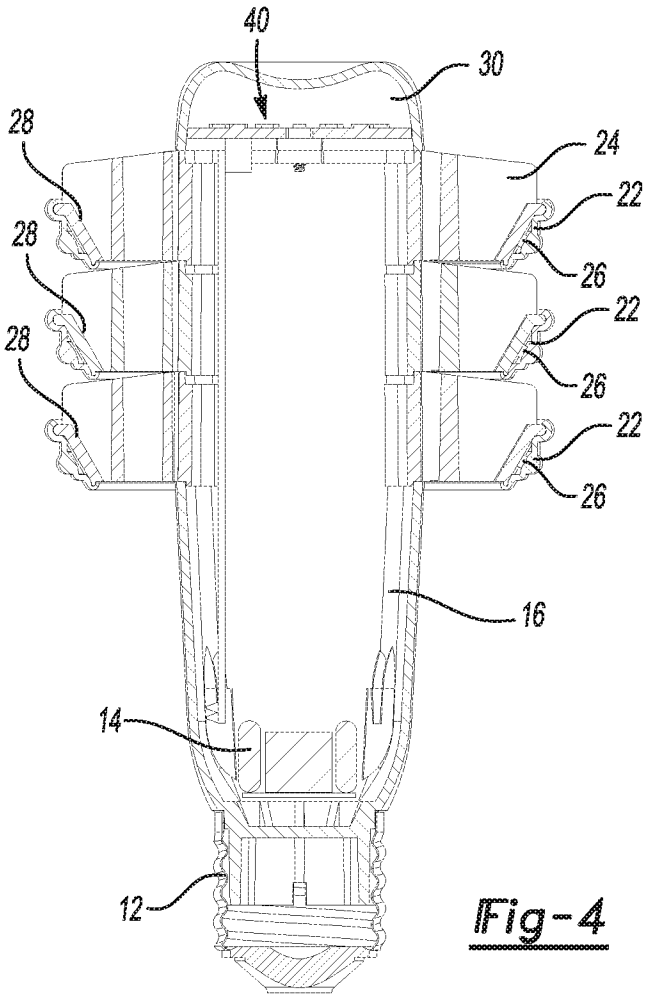
FIG. 4 illustrates a cutaway side view of one embodiment of a LED light assembly according to one or more embodiments shown and described herein.
Figure 3:
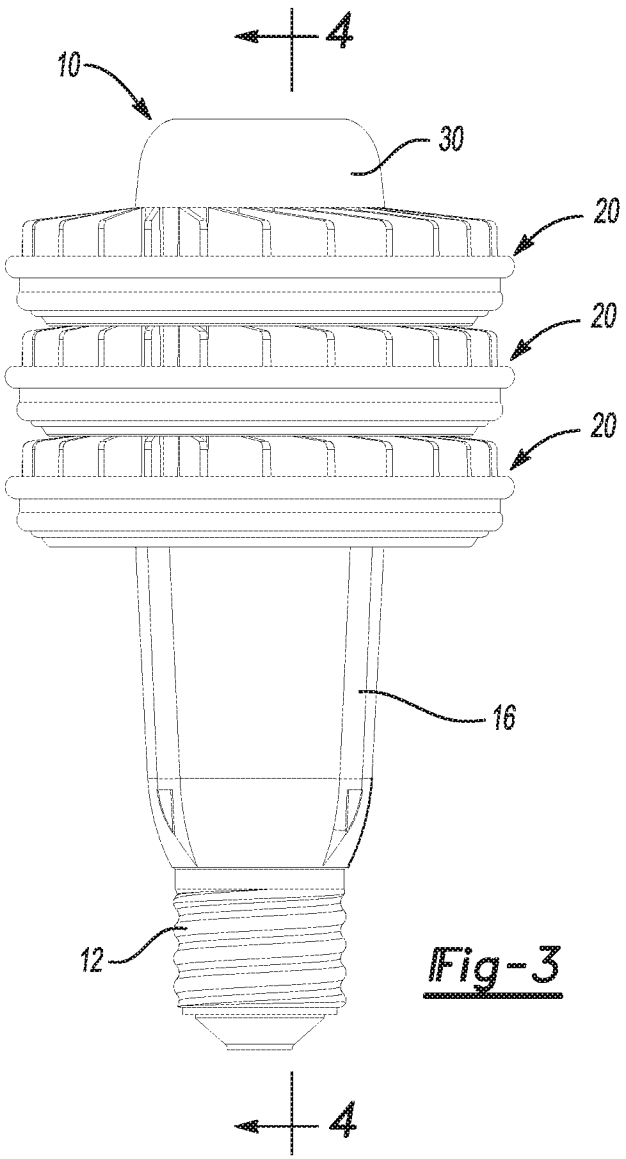
FIG. 3 illustrates a side view of one embodiment of a LED light assembly according to one or more embodiments shown and described herein.
Figure 5:
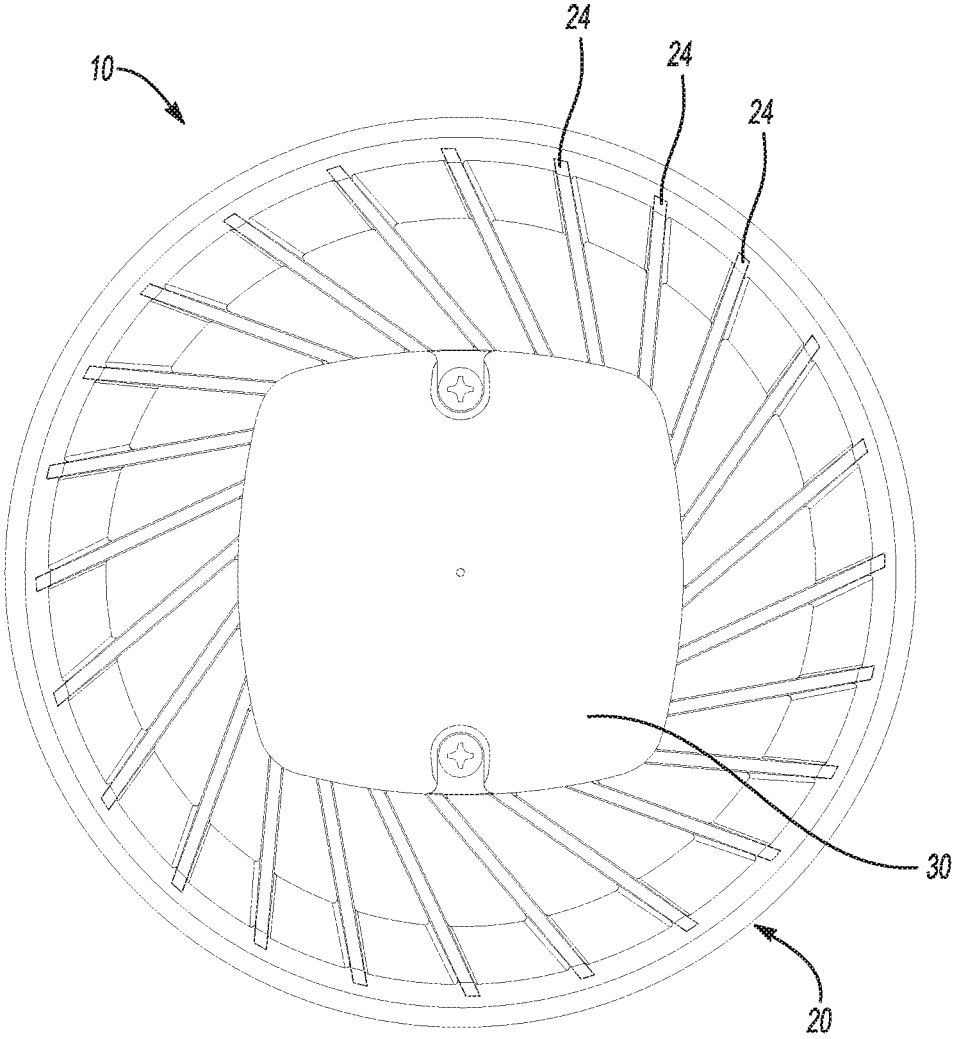
FIG. 5 illustrates a top view of one embodiment of a LED light assembly according to one or more embodiments shown and described herein.
Figure 6:
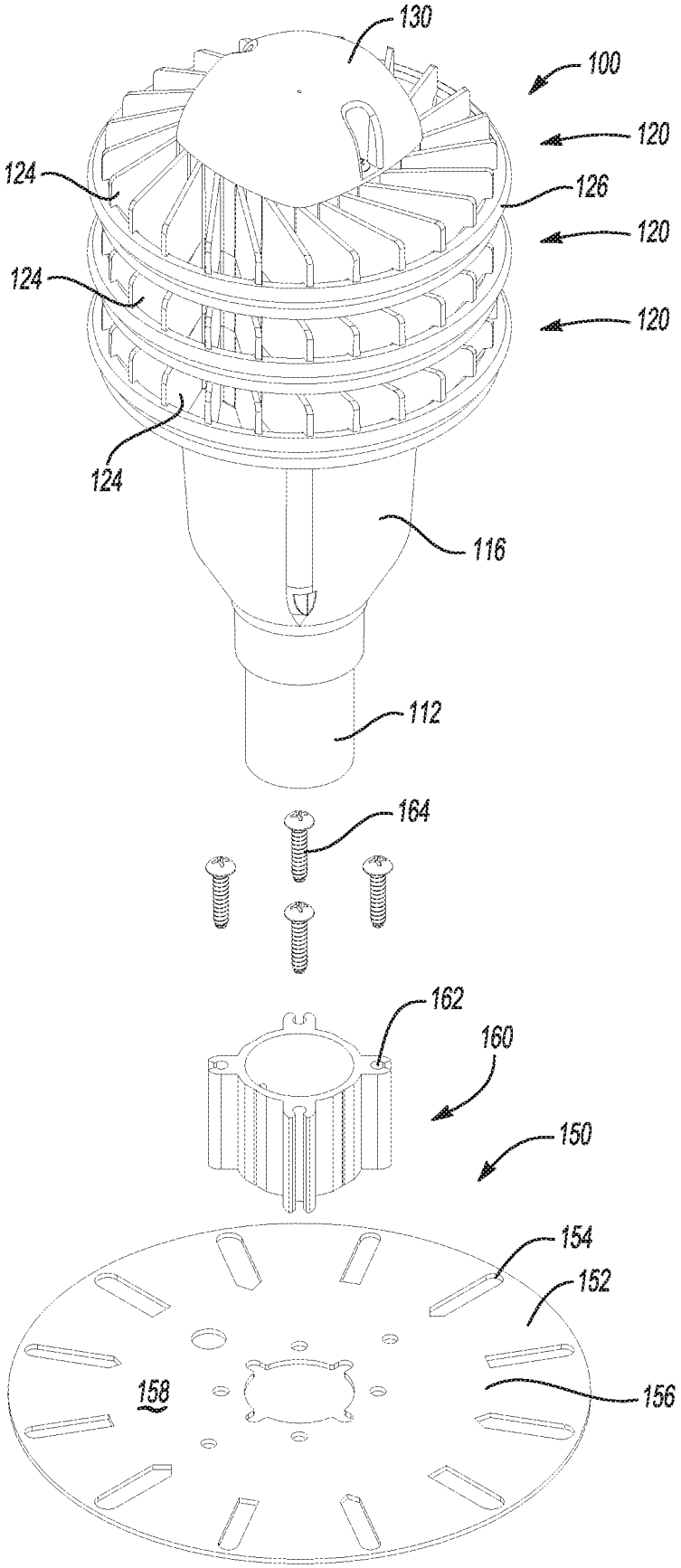
FIG. 6 illustrates an exploded perspective view of another embodiment of a LED assembly having a fixed plate according to one or more embodiments shown and described herein.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Generally, the LED lighting assemblies of the present invention provide a RGBW or RGB (collectively and/or interchangeably referred to as "RGB" throughout this specification) colored light supplied by a screw in, fixed plate, or other light source, or as a stand-alone module in applications such as within luminaires for decorative purposes, within luminaires for signaling purposes, on the surface of luminaires for decorative purposes and/or within luminaires for signaling purposes. RGB lights may be directed predominantly horizontal (side directed RGB lighting) and/or RGB lights may be directed in order to illuminate a luminaire, luminaire globe, or surrounding surfaces. Laser uplight or sidelight for coloration of the luminaire, luminaire globe, surrounding surfaces, or for signaling may also be used.

An LED light assembly 10 is generally presented, as illustrated in FIGS. 1-5. The LED light assembly 10 may be configured to generally replace a large traditional light bulb, such as within a decorative fixture. The LED light assembly 10 may include a threaded base 12 and voltage conversion components 14 to allow the assembly 10 to be easily retro fit with a standard light bulb socket. However, it will be understood that the assembly 10 may also be configured to be powered directly by a low voltage power supply to power the LED lights. A dedicated ground wire may be used in either configuration to provide improved surge protection.

As illustrated in FIGS. 1-5, the LED light assembly 10 may include a housing 16. The housing 16 may extend upwards from the base and may generally comprise a cylindrical shape. The housing 16 may be generally hollow, and may house components, such as the voltage conversion components inside. The housing may extend from the base 12 to the top of the assembly 10. The housing, driver portions, or optic portions may be potted so as to include silicone or other similar materials to improve thermal management—the potting may surround the circuit board.

The assembly 10 may include one or more lighting elements 20 connected and/or positioned radially around the assembly. In most embodiments, each ring as illustrated in most figures includes 40-120 lighting elements per ring.

The lighting elements 20 may each comprise a plurality of LEDs 22. The LEDs 22 may be any appropriate color LED, or any appropriate mixtures of LED colors. The LEDs 22 may be carried on a printed circuit board 28, such as a flexible printed circuit board, to allow for circular bending of the lighting element 20.

In an embodiment, one or more of the lighting elements 20 may be arranged at a predetermined angle with respect to the housing, or a predetermined angle with respect to the street, walkway or surface intended to be lit. For example, one or more of the lighting elements 20 may be angled at approximately 30 degrees downward from the vertical positioning of the outer housing wall. It will be appreciated, however, that the lighting elements 20 may be positioned at any appropriate angle to increase ground lighting and reduce glare.

The lighting elements 20 may be connected to heat sinks 24. The heat sinks 24 may extend around the perimeter of the housing 16 behind the lighting elements 20 to disperse heat emitted from the lighting elements 20. The heat sinks 24 may comprise a plurality of panels at a given angle to increase surface area and contact with ambient air.

The lighting elements 20 may further include an optic 26. The optic 26 may be positioned over an outer portion of the lighting elements 20 to disperse light emitted from the lighting elements 20. The optic 26 may be formed of a soft or flexible substance, such as silicone, and may extend in a circular manner about the entirety of the circumference of the lighting element 20. The optic 26 may further function to disperse and dissipate heat from the lighting element 20.

In an embodiment, the lighting elements 20 may be arranged and positioned respective to one another to tune the emitted light to match its accompanying fixture or globe. For example, existing light fixtures may have translucent globes that are designed to house a traditional light source with a two inch light width. The lighting elements 20 may be spaced at a 2 inch high lit region to provide a light source that matches the design of the traditional light source.

The LED light assembly 10 may include a top cap 30. The top cap may be positioned at or near the top of the assembly 10 and may include additional LED light sources 40. The top cap LEDs may direct light vertically upward or at an angled direction from the top of the LED light assembly. In an embodiment, the top cap 30 may be removable from the light assembly 10, or selectively attached thereto. The top cap 30 may further include varying colored lights to provide a colored top light.

In an embodiment, the LED light assembly 10 may be configured to variably provide different lighting schemes. For example, the LED light assembly 10 may include a controller. The controller may be configured to control the intensity of individual LEDs or groups of LEDs on each lighting element 20. For example, the controller may adjust the output of the LEDs around the circular light element 20 to all have an equal or full light intensity. This will result in a full circular light pattern that is cast around the area surrounding the LED light assembly. The controller may also vary the LED outputs to turn off or dim LEDs on one or more sides or sections of the assembly 10. For example, an LED light assembly 10 used in a street lamp positioned between a sidewalk and a street may have the lights facing the sidewalk or businesses/houses near the sidewalk dimmed as compared to the lights that face the street. This allows for tuning of each LED light assembly to fit its individual use application.

It will be appreciated that the lights on a lighting element may be controlled in quadrants, such that each quarter of the circular lighting element 20 may be controlled to have the same output or intensity. Alternatively, the lighting elements 20 may be controlled in other groupings, or even down to individual control of each LED.

An LED light assembly 100 is generally presented, as illustrated in FIGS. 6-9. The LED light assembly 100 may be configured to generally replace a large traditional light bulb, such as within a decorative fixture. The LED light assembly 100 may include a support and positioning element 112 and voltage conversion components to allow the assembly 100 to be fit in a standard light fixture. However, it will be understood that the assembly 100 may also be configured to be powered directly by a low voltage power supply to power the LED lights. A dedicated ground wire may be used in either configuration to provide improved surge protection.

Figure 8:
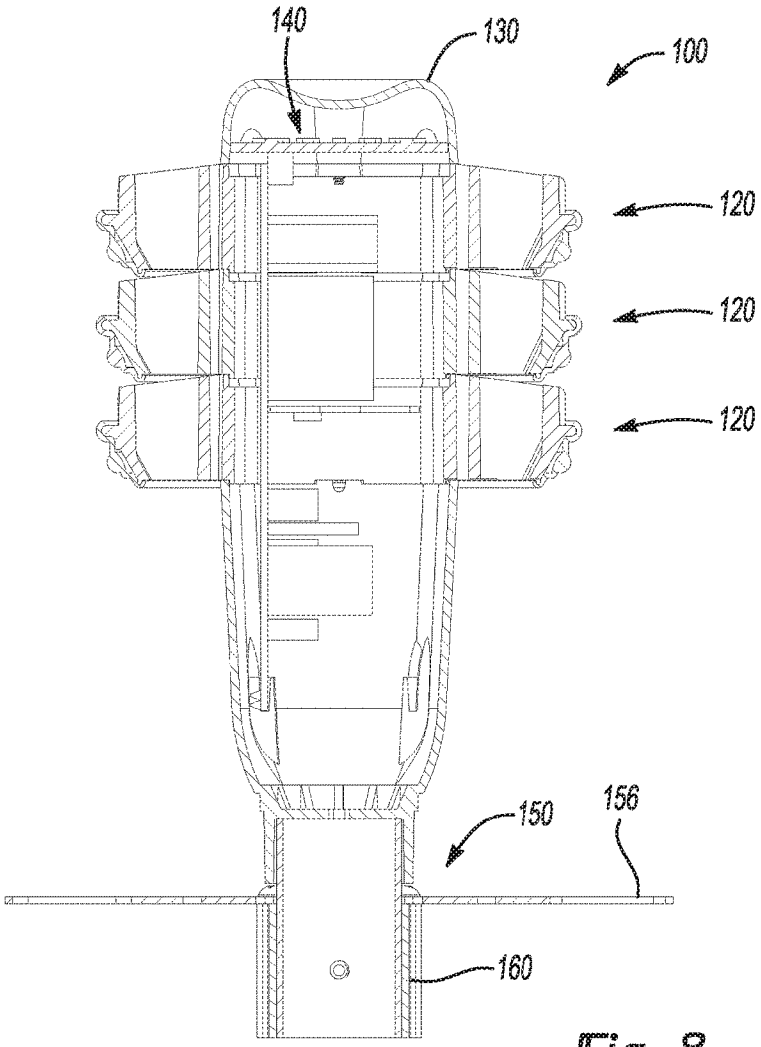
FIG. 8 illustrates a cutaway side view of another embodiment of a LED assembly having a fixed plate according to one or more embodiments shown and described herein.
Figure 7:
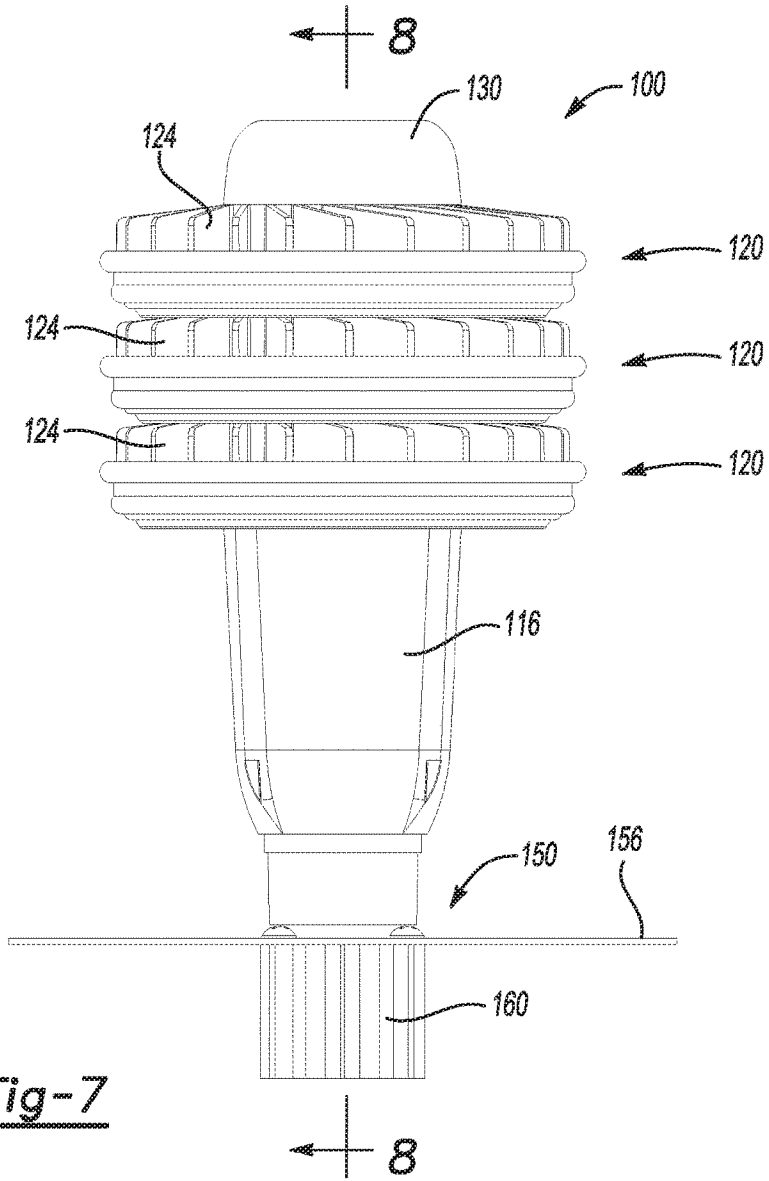
FIG. 7 illustrates a side view of another embodiment of a LED assembly having a fixed plate according to one or more embodiments shown and described herein.
Figure 9:
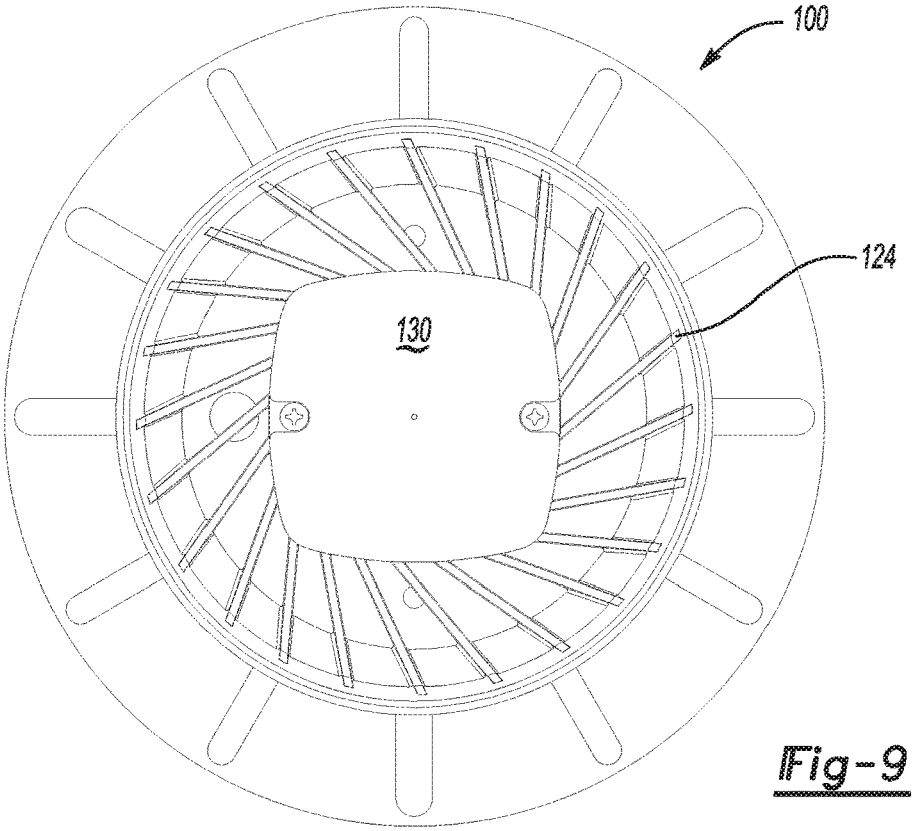
FIG. 9 illustrates a top view of another embodiment of a LED assembly having a fixed plate according to one or more embodiments shown and described herein.
Figure 10:
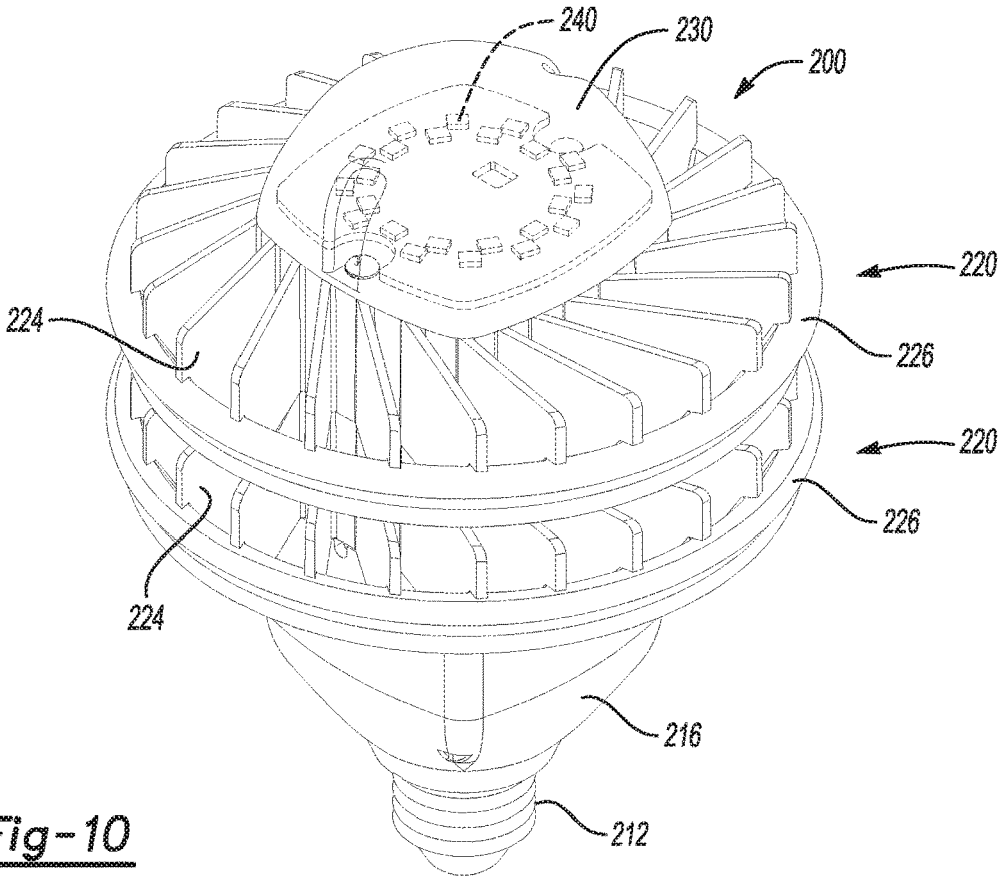
FIG. 10 illustrates a perspective view of yet another embodiment of a LED assembly according to one or more embodiments shown and described herein.
Figure 12:
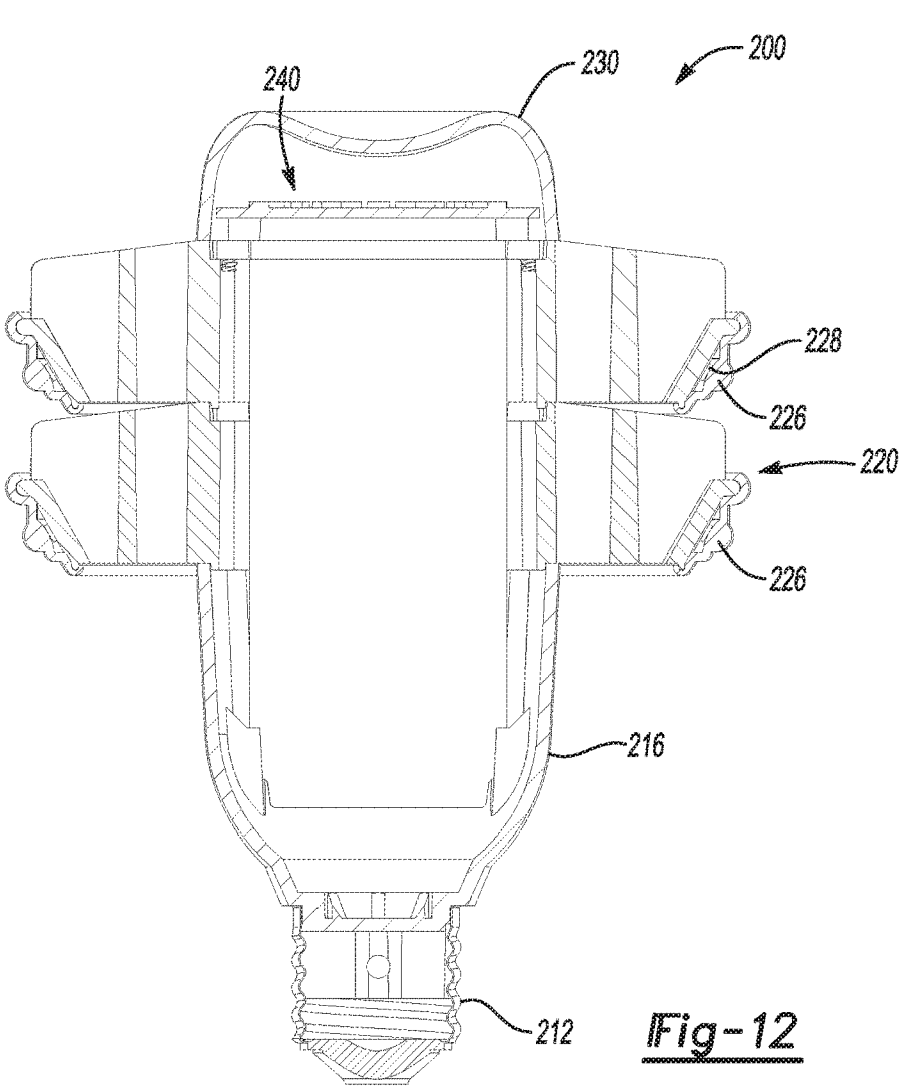
FIG. 12 illustrates a cutaway side view of yet another embodiment of a LED assembly according to one or more embodiments shown and described herein.
Figure 11:
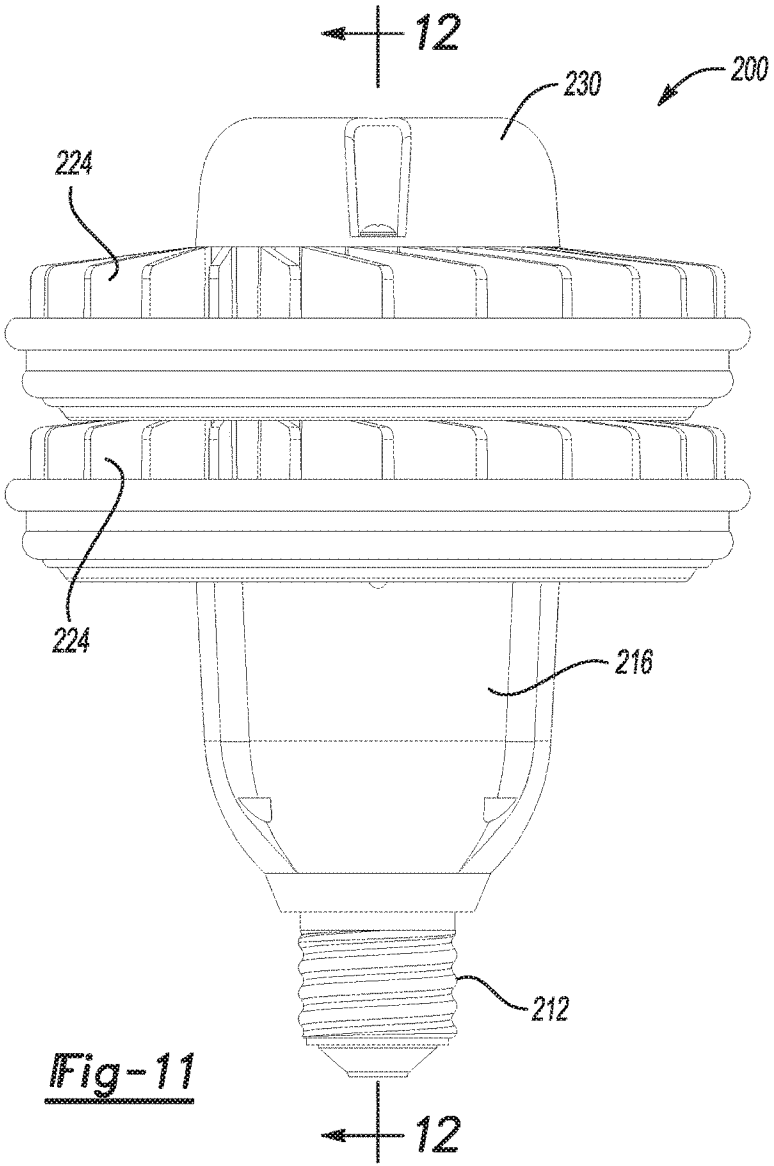
FIG. 11 illustrates a side view of yet another embodiment of a LED assembly according to one or more embodiments shown and described herein.
Figure 13:
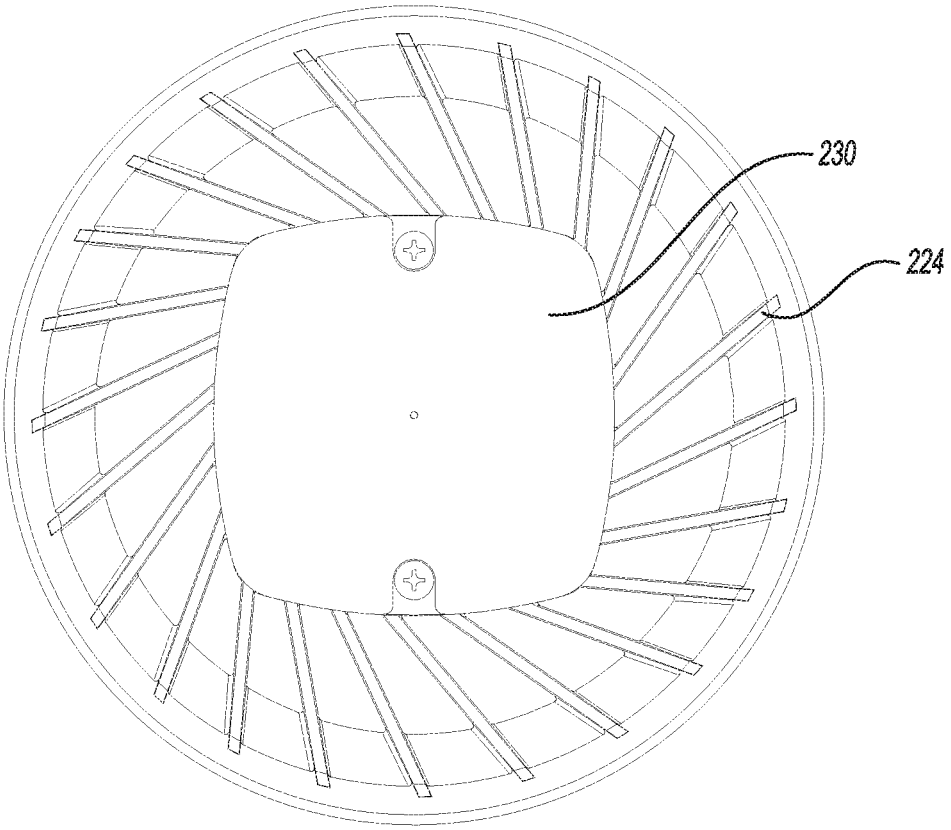
FIG. 13 illustrates a top view of yet another embodiment of a LED assembly according to one or more embodiments shown and described herein.
Figure 14:
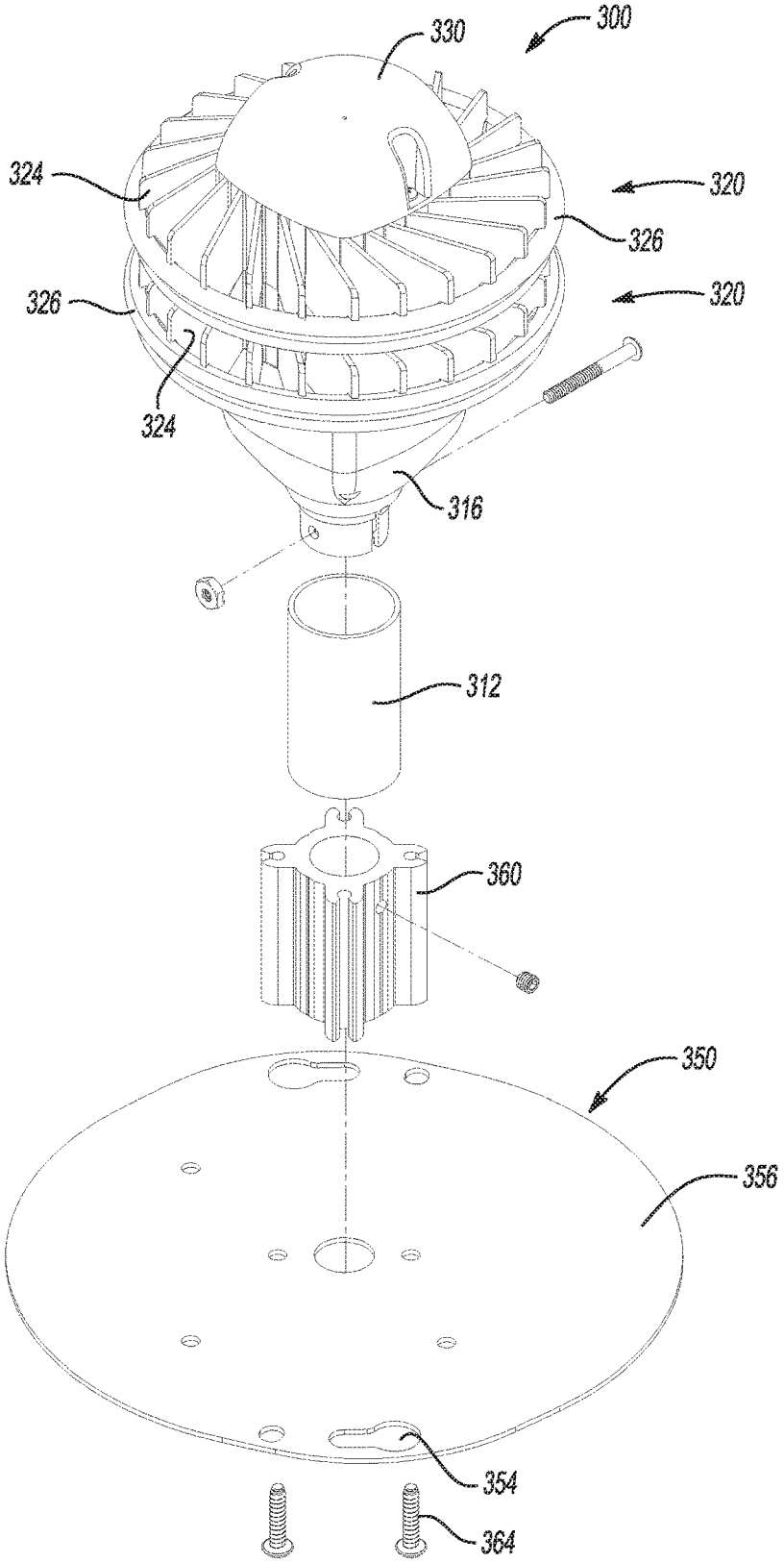
FIG. 14 illustrates an exploded perspective view of yet another embodiment of a LED assembly having a fixed plate according to one or more embodiments shown and described herein.
Figure 16:
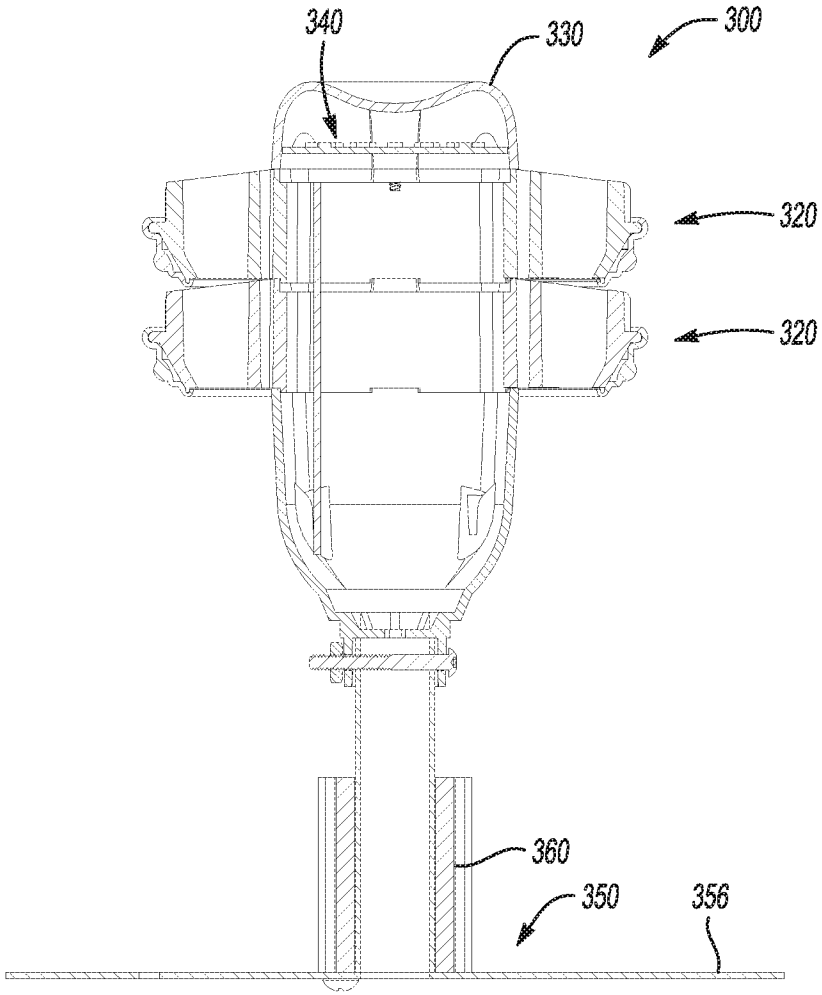
FIG. 16 illustrates a cutaway side view of yet another embodiment of a LED assembly having a fixed plate according to one or more embodiments shown and described herein.
Figure 15:
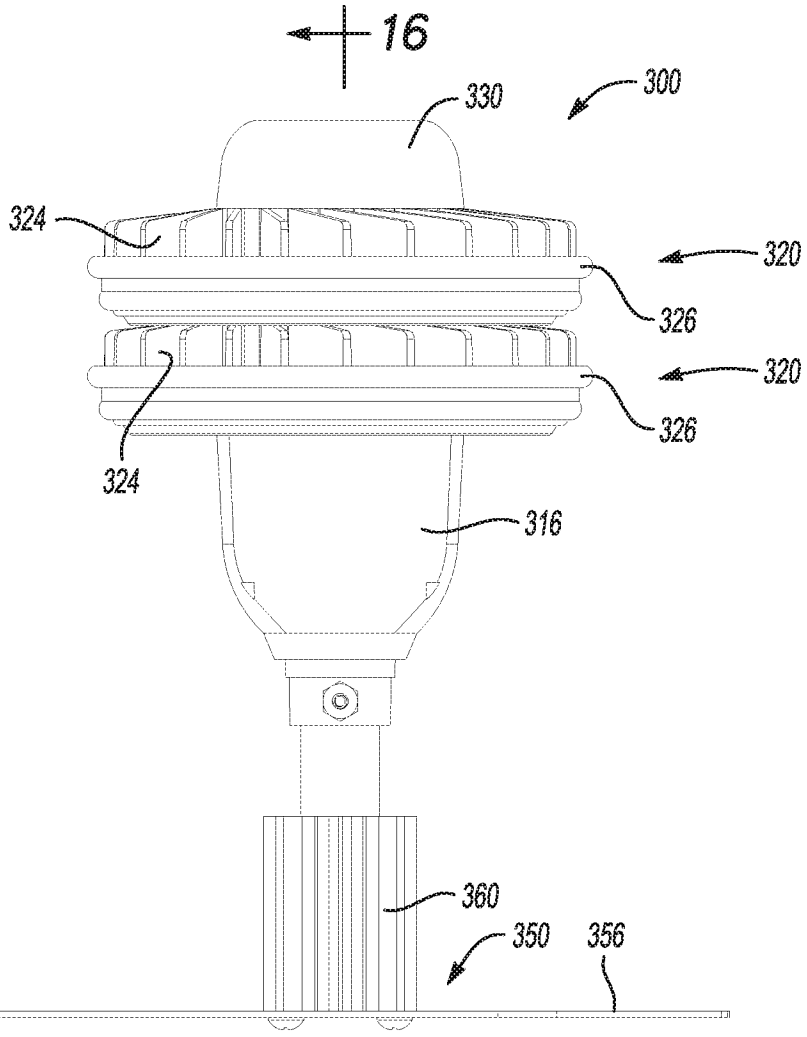
FIG. 15 illustrates a side view of yet another embodiment of a LED assembly having a fixed plate according to one or more embodiments shown and described herein.
Figure 17:
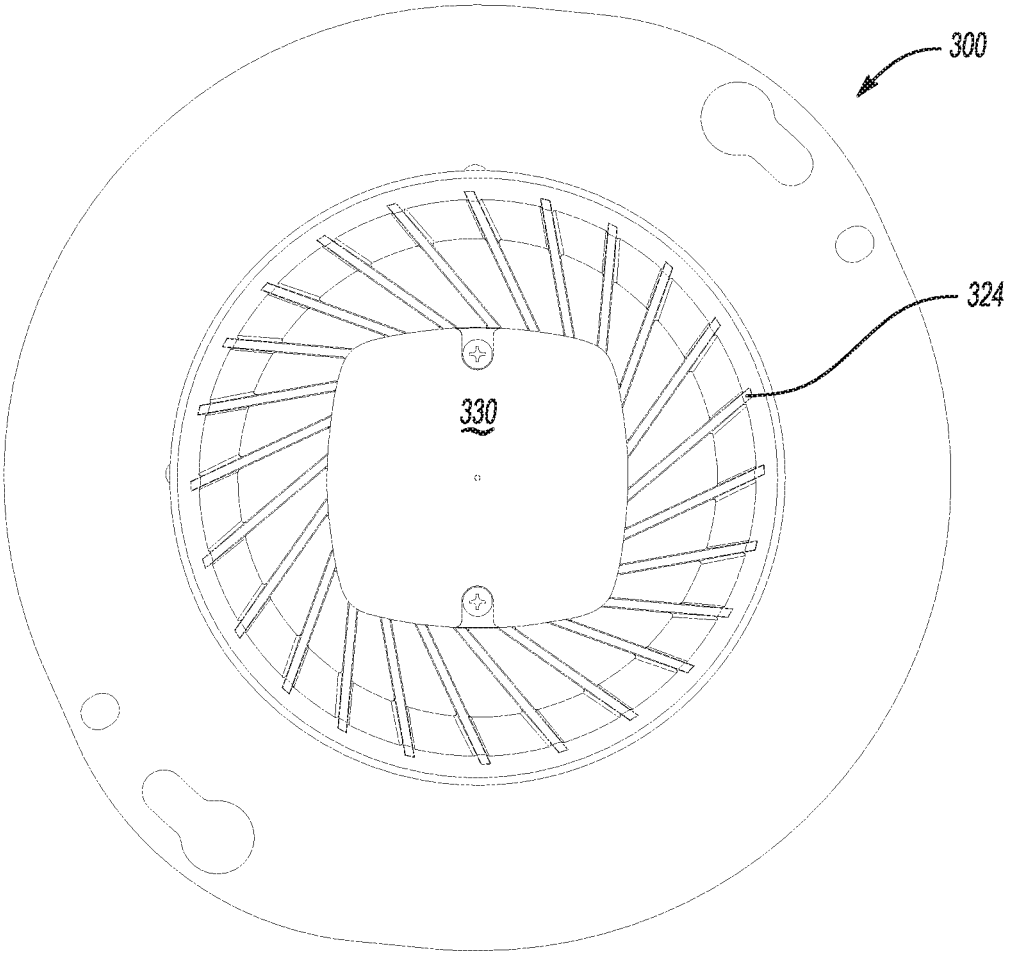
FIG. 17 illustrates a top view of yet another embodiment of a LED assembly having a fixed plate according to one or more embodiments shown and described herein.

The LED light assembly 100 further includes a fixed base 150. The fixed base is configured to connect directly to a light fixture to allow the assembly of the present specification to be used in connection with said light fixture. Said fixed base includes a main plate 156 having a planar or formed surface 152 with a plurality of connection apertures 154. In this embodiment, a sleeve 160 includes connection portion 162 resting on top of the upper surface 158 of the main plate 152. Screws or other fasteners 164 are used to connect the sleeve 160 to the main plate 152. In other embodiment, the sleeve may be on the reverse side of the main plate 152 (such as shown in FIGS. 7 and 8) but should not be limited to either configuration.

As illustrated in FIGS. 6-9, the LED light assembly 100 may include a housing 116. The housing 116 may extend upwards from the base and may generally comprise a cylindrical, or similar, shape. The housing 116 may be generally hollow, and may house components, such as the voltage conversion components inside. The housing may extend from the element 112 to the top of the assembly 100. The housing, driver portions, or optic portions may be potted so as to include silicone or other similar materials to improve thermal management—the potting may surround the circuit board and/or driver components or any other part of the assembly as shown.

The assembly 100 may include one or more lighting elements 120 positioned and/or connected radially around the assembly. For example, the lighting elements 120 may be generally circular and sized and shaped to fit around the housing 116 or in line with the housing 116. In most embodiments, each ring as illustrated in most figures includes 40-120 lighting elements per ring.

The lighting elements 120 may each comprise a plurality of LEDs. The LEDs may be any appropriate color LED, or any appropriate mixtures of LED colors. The LEDs may be carried on a printed circuit board, such as a flexible printed circuit board, to allow for circular bending of the lighting element 120.

In an embodiment, one or more of the lighting elements 120 may be arranged at a predetermined angle with respect to the housing, or a predetermined angle with respect to the street, walkway or surface intended to be lit. For example, one or more of the lighting elements 120 may be angled at approximately 30 degrees downward from the vertical positioning of the outer housing wall. It will be appreciated, however, that the lighting elements 120 may be positioned at any appropriate angle to increase ground lighting and reduce glare.

The lighting elements 120 may be connected to heat sinks 124. The heat sinks 124 may extend around the perimeter of the housing 116 behind the lighting elements 120 to disperse heat emitted from the lighting elements 120. The heat sinks 124 may comprise a plurality of panels at a given angle to increase surface area and contact with ambient air.

The lighting elements 120 may further include an optic 126. The optic 126 may be positioned over an outer portion of the lighting elements 120 to disperse light emitted from the lighting elements 120. The optic 126 may be formed of a soft or flexible substance, such as silicone, and may extend in a circular manner about the entirety of the circumference of the lighting element 120. The optic 126 may further function to disperse and dissipate heat from the lighting element 120.

In an embodiment, the lighting elements 120 may be arranged and positioned respective to one another to tune the emitted light to match its accompanying fixture or globe. For example, existing light fixtures may have translucent globes that are designed house a traditional light source with a two inch light width. The lighting elements 120 may be spaced at a 2 inch high lit region to provide a light source that matches the design of the traditional light source. The LED light assembly 100 may include a top cap 130. The top cap may be positioned at or near the top of the assembly 100 and may include additional LED light sources 140. The top cap LEDs may direct light vertically upward or at an angled direction from the top of the LED light assembly. In an embodiment, the top cap 130 may be removable from the light assembly 100, or selectively attached thereto. The top cap 130 may further include varying colored lights to provide a colored top light.

In an embodiment, the LED light assembly 100 may be configured to variably provide different lighting schemes. For example, the LED light assembly 100 may include a controller. The controller may be configured to control the intensity of individual LEDs or groups of LEDs on each lighting element 120. For example, the controller may adjust the output of the LEDs around the circular light element 120 to all have an equal or full light intensity. This will result in a full circular light pattern that is cast around the area surrounding the LED light assembly. The controller may also vary the LED outputs to turn off or dim LEDs on one or more sides or sections of the assembly 100. For example, an LED light assembly 100 used in a street lamp positioned between a sidewalk and a street may have the lights facing the sidewalk or businesses/houses near the sidewalk dimmed as compared to the lights that face the street. This allows for tuning of each LED light assembly to fit its individual use application.

It will be appreciated that the lights on a lighting element may be controlled in quadrants, such that each quarter of the circular lighting element 120 may be controlled to have the same output or intensity. Alternatively, the lighting elements 120 may be controlled in other groupings, or even down to individual control of each LED.

An LED light assembly 200 is generally presented, as illustrated in FIGS. 10-13. The LED light assembly 200 may be configured to generally replace a large traditional light bulb, such as within a decorative fixture. The LED light assembly 200 may include a threaded base 212 and voltage conversion components to allow the assembly 200 to be easily retro fit with a standard light bulb socket. However, it will be understood that the assembly 200 may also be configured to be powered directly by a low voltage power supply to power the LED lights. A dedicated ground wire may be used in either configuration to provide improved surge protection.

As illustrated in FIGS. 10-13, the LED light assembly 200 may include a housing 216. The housing 216 may extend upwards from the base and may generally comprise a cylindrical shape. The housing 216 may be generally hollow, and may house components, such as the voltage conversion components inside. The housing may extend from the base 212 to the top of the assembly 200. The housing, driver portions, or optic portions may be potted so as to include silicone or other similar materials to improve thermal management—the potting may surround the circuit board.

The assembly 200 may include one or more lighting elements 220 connected and/or positioned radially around the assembly. For example, the lighting elements 220 may be generally circular and sized and shaped to fit around the housing 216 or in line with the housing 216. In most embodiments, each ring as illustrated in most figures includes 84-88 lighting elements per ring.

The lighting elements 220 may each comprise a plurality of LEDs. The LEDs may be any appropriate color LED, or any appropriate mixtures of LED colors. The LEDs may be carried on a printed circuit board, such as a flexible printed circuit board, to allow for circular bending of the lighting element 220.

In an embodiment, one or more of the lighting elements 220 may be arranged at a predetermined angle with respect to the housing, or a predetermined angle with respect to the street, walkway or surface intended to be lit. For example, one or more of the lighting elements 220 may be angled at approximately 30 degrees downward from the vertical positioning of the outer housing wall. It will be appreciated, however, that the lighting elements 220 may be positioned at any appropriate angle to increase ground lighting and reduce glare.

The lighting elements 220 may be connected to heat sinks 24. The heat sinks 24 may extend around the perimeter of the housing 216 behind the lighting elements 220 to disperse heat emitted from the lighting elements 220. The heat sinks 24 may comprise a plurality of panels at a given angle to increase surface area and contact with ambient air.

The lighting elements 220 may further include an optic 226 positioned adjacent to the LED 228. The optic 226 may be positioned over an outer portion of the lighting elements 220 to disperse light emitted from the lighting elements 220. The optic 226 may be formed of a soft or flexible substance, such as silicone, and may extend in a circular manner about the entirety of the circumference of the lighting element 220. The optic 226 may further function to disperse and dissipate heat from the lighting element 220.

In an embodiment, the lighting elements 220 may be arranged and positioned respective to one another to tune the emitted light to match its accompanying fixture or globe. For example, existing light fixtures may have translucent globes that are designed house an traditional light source with a two inch light width. The lighting elements 220 may be spaced so as to mimic the appearance and fit of a traditional light bulb.

The LED light assembly 200 may include a top cap 230. The top cap may be positioned at or near the top of the assembly 200 and may include additional LED light sources 240. The top cap LEDs may direct light vertically upward or at an angled direction from the top of the LED light assembly. In an embodiment, the top cap 230 may be removable from the light assembly 10, or selectively attached thereto. The top cap 230 may further include varying colored lights to provide a colored top light. In the present embodiment, a plurality of LEDs 24 are incorporated.

In an embodiment, the LED light assembly 200 may be configured to variably provide different lighting schemes. For example, the LED light assembly 200 may include a controller. The controller may be configured to control the intensity of individual LEDs or groups of LEDs on each lighting element 220. For example, the controller may adjust the output of the LEDs around the circular light element 220 to all have an equal or full light intensity. This will result in a full circular light pattern that is cast around the area surrounding the LED light assembly. The controller may also vary the LED outputs to turn off or dim LEDs on one or more sides or sections of the assembly 10. For example, an LED light assembly 200 used in a street lamp positioned between a sidewalk and a street may have the lights facing the sidewalk or businesses/houses near the sidewalk dimmed as compared to the lights that face the street. This allows for tuning of each LED light assembly to fit its individual use application.

It will be appreciated that the lights on a lighting element may be controlled in quadrants, such that each quarter of the circular lighting element 220 may be controlled to have the same output or intensity. Alternatively, the lighting elements 220 may be controlled in other groupings, or even down to individual control of each LED.

An LED light assembly 300 is generally presented, as illustrated in FIGS. 14-17. The LED light assembly 300 may be configured to generally replace a large traditional light bulb, such as within a decorative fixture. The LED light assembly 300 may include a supporting and positioning element 312 and voltage conversion components to allow the assembly 300 to be fit in a standard light fixture. However, it will be understood that the assembly 300 may also be configured to be powered directly by a low voltage power supply to power the LED lights. A dedicated ground wire may be used in either configuration to provide improved surge protection.

The LED light assembly 300 further includes a fixed base 350. The fixed base is configured to connect directly to a light fixture to allow the assembly of the present specification to be used in connection with said light fixture. Said fixed base includes a main plate 356 having a planar or formed surface with a plurality of connection apertures 354. In this embodiment, a sleeve 360 includes a connection portion. Screws or other fasteners 364 are used to connect the sleeve 360 to the main plate 356. In other embodiment, the sleeve may be on the reverse side of the main plate 356 but should not be limited to either configuration.

As illustrated in FIGS. 14-17, the LED light assembly 300 may include a housing 316. The housing 316 may extend upwards from the base and may generally comprise a cylindrical, or similar, shape. The housing 316 may be generally hollow, and may house components, such as the voltage conversion components inside. The housing may extend from the element 312 to the top of the assembly 300. The housing, driver portions, or optic portions may be potted so as to include silicone or other similar materials to improve thermal management—the potting may surround the circuit board and/or driver components or any other part of the assembly as shown.

The assembly 300 may include one or more lighting elements 320 connected and/or positioned radially around the assembly. For example, the lighting elements 320 may be generally circular and sized and shaped to fit around the housing 316 or in line with the housing 316. In most embodiments, each ring as illustrated in most figures includes 84-88 lighting elements per ring.

The lighting elements 320 may each comprise a plurality of LEDs. The LEDs may be any appropriate color LED, or any appropriate mixtures of LED colors. The LEDs may be carried on a printed circuit board, such as a flexible printed circuit board, to allow for circular bending of the lighting element 320.

In an embodiment, one or more of the lighting elements 320 may be arranged at a predetermined angle with respect to the housing, or a predetermined angle with respect to the street, walkway or surface intended to be lit. For example, one or more of the lighting elements 320 may be angled at approximately 30 degrees downward from the vertical positioning of the outer housing wall. It will be appreciated, however, that the lighting elements 320 may be positioned at any appropriate angle to increase ground lighting and reduce glare.

The lighting elements 320 may be connected to heat sinks 324. The heat sinks 324 may extend around the perimeter of the housing 316 behind the lighting elements 320 to disperse heat emitted from the lighting elements 320. The heat sinks 324 may comprise a plurality of panels at a given angle to increase surface area and contact with ambient air.

The lighting elements 320 may further include an optic 326. The optic 326 may be positioned over an outer portion of the lighting elements 320 to disperse light emitted from the lighting elements 320. The optic 326 may be formed of a soft or flexible substance, such as silicone, and may extend in a circular manner about the entirety of the circumference of the lighting element 320. The optic 326 may further function to disperse and dissipate heat from the lighting element 320.

In an embodiment, the lighting elements 320 may be arranged and positioned respective to one another to tune the emitted light to match its accompanying fixture or globe. For example, existing light fixtures may have translucent globes that are designed house a traditional light source with a two inch light width. The lighting elements 320 may be spaced so as to mimic the appearance and fit of a traditional light bulb.

The LED light assembly 300 may include a top cap 330. The top cap may be positioned at or near the top of the assembly 300 and may include additional LED light sources 340. The top cap LEDs may direct light vertically upward or at an angled direction from the top of the LED light assembly. In an embodiment, the top cap 330 may be removable from the light assembly 300, or selectively attached thereto. The top cap 130 may further include varying colored lights to provide a colored top light.

In an embodiment, the LED light assembly 300 may be configured to variably provide different lighting schemes. For example, the LED light assembly 300 may include a controller. The controller may be configured to control the intensity of individual LEDs or groups of LEDs on each lighting element 320. For example, the controller may adjust the output of the LEDs around the circular light element 320 to all have an equal or full light intensity. This will result in a full circular light pattern that is cast around the area surrounding the LED light assembly. The controller may also vary the LED outputs to turn off or dim LEDs on one or more sides or sections of the assembly 300. For example, an LED light assembly 300 used in a street lamp positioned between a sidewalk and a street may have the lights facing the sidewalk or businesses/houses near the sidewalk dimmed as compared to the lights that face the street. This allows for tuning of each LED light assembly to fit its individual use application.

It will be appreciated that the lights on a lighting element may be controlled in quadrants, such that each quarter of the circular lighting element 320 may be controlled to have the same output or intensity. Alternatively, the lighting elements 320 may be controlled in other groupings, or even down to individual control of each LED.

Figure 18:
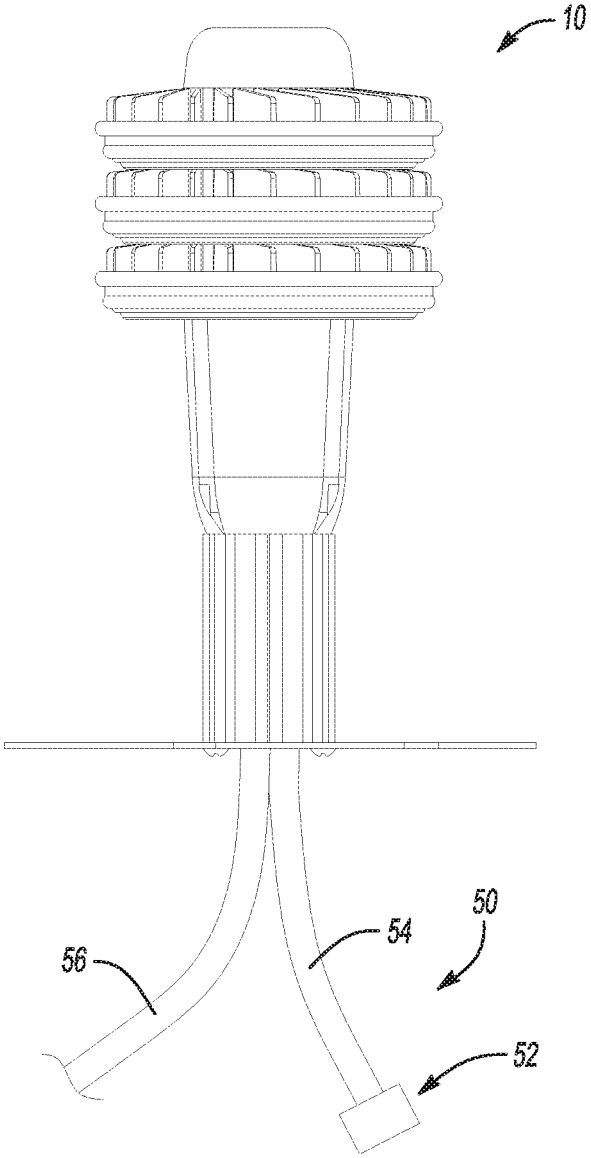
FIG. 18 illustrates a side view of an embodiment of a LED assembly according to one or more embodiments shown and described herein.
Figure 19:
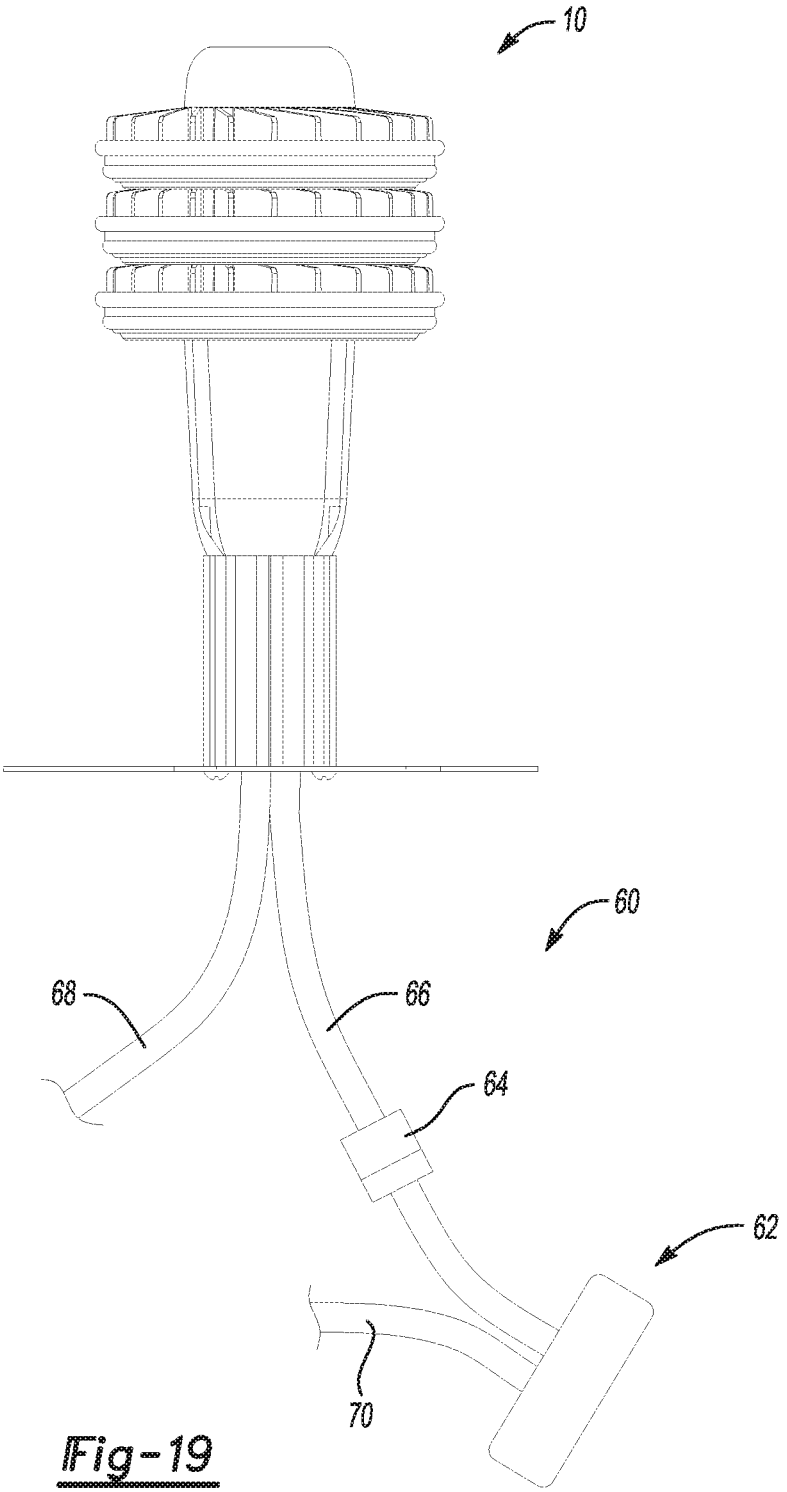
FIG. 19 illustrates a side view of an alternative embodiment of a LED assembly according to one or more embodiments shown and described herein.
Figure 20:
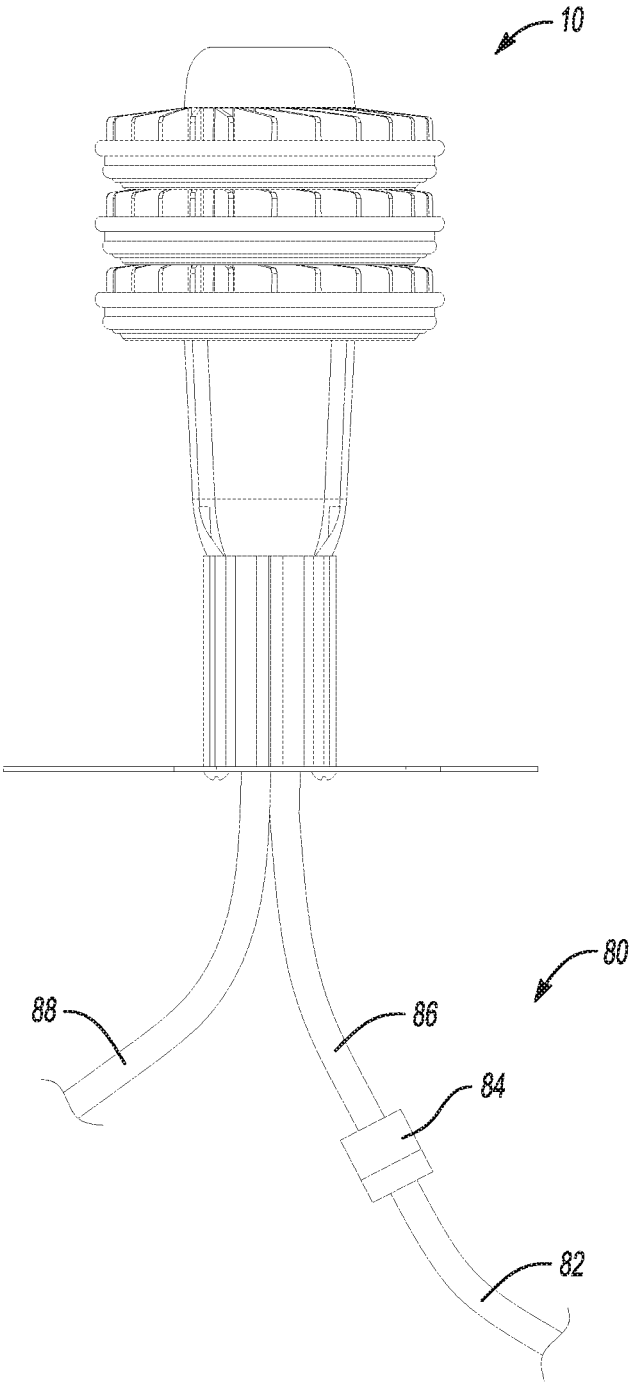
FIG. 20 illustrates a side view of yet another alternative embodiment of a LED assembly according to one or more embodiments shown and described herein.

FIGS. 18-20 depict various embodiments of the photocell & dimming socket and receptacle feature of the present specification. It should be noted that the terms "receptacle" and "socket" may be used interchangeably as referenced in this present specification and/or in the accompanying claims. The wiring and photocell systems as illustrated in FIGS. 18-20 may be applied to any of the LED light assembly embodiments as shown herein. FIG. 18 depicts an exemplary LED light 10 (although it should be appreciate that any light assembly is suitable) having a system 50 including a connector 52 (which may be a single half of the mating connector pair or halves of mating connector pairs), a photocell receptacle wire bundle(s) 54 and a service wire bundle 56 for providing power and ground to the lamp. FIG. 19 depicts an exemplary LED light 10 (although it should be appreciate that any light assembly is suitable) having a system 60 including a connector 64 (which may be a single mating connector pair or multiple mating connector pairs), a photocell receptacle 62 (which may be a 3, 5, or 7 pin), a photocell receptacle wire bundle(s) 66 and a service wire bundle 68 for providing power and ground to the lamp. FIG. 20 depicts an exemplary LED light 10 (although it should be appreciate that any light assembly is suitable) having a system 80 including a connector 84 (which may be a single mating connector pair or multiple mating connector pairs), a photocell receptacle wire bundle(s) 86, a wire bundle(s) 82 for future connection to a photocell receptacle or other control components, and a service wire bundle 88 for providing power and ground to the lamp 3, 5, or 7 Pin Photocell socket wired to a screw in, fixed LED lamp, or stand alone module for control, communication, or signaling purposes. The photocell (or other similar device) assembly as described herein is provided to enable external hardware to control the lamp externally. The receptacle as provided herein enables control from external devices so as to control dimming, color, on/off, change to light distribution . . . etc. In some embodiments, a Gateway device (or other similar device) that interfaces with that could interface with a 3, 5, or 7 pin photocell socket, designed to act as a gateweay between Bluetooth devices and other protocol communication methods may be utilized in some embodiments. In other embodiments, a Gateway device that fits into a 3, 5, or 7 pin photocell socket, designed to act as a gateway between LoRa devices and other protocol communication methods may be used.

Figure 21:
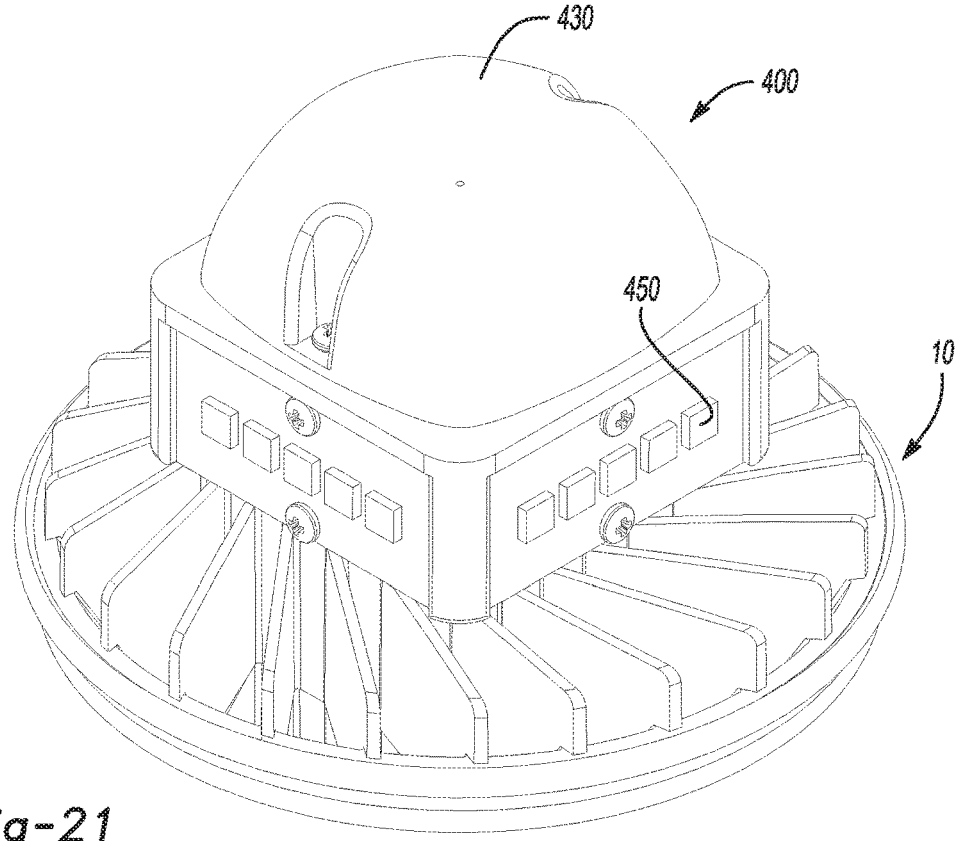
FIG. 21 depicts an perspective view of an alternative embodiment uplight cap having RGBW lighting capability according to one or more embodiments shown and described herein.
Figure 22:
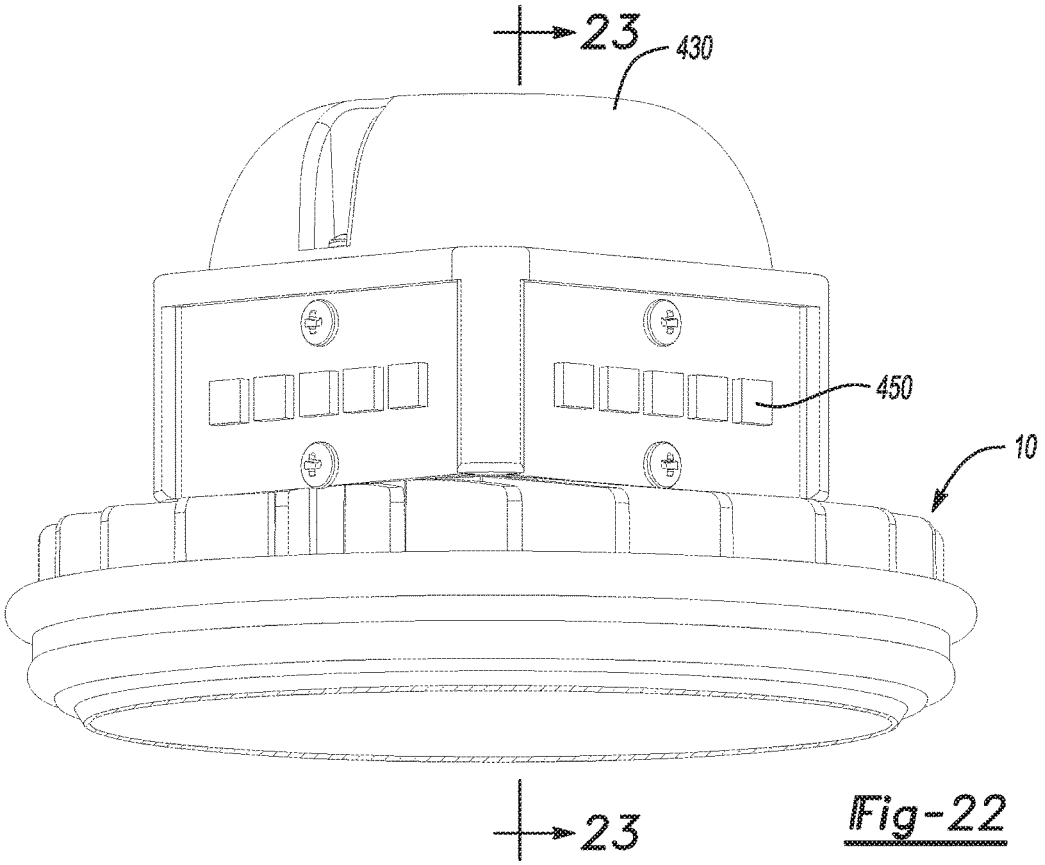
FIG. 22 depicts a side view of an alternative embodiment uplight cap having RGBW lighting capability according to one or more embodiments shown and described herein.
Figure 23:
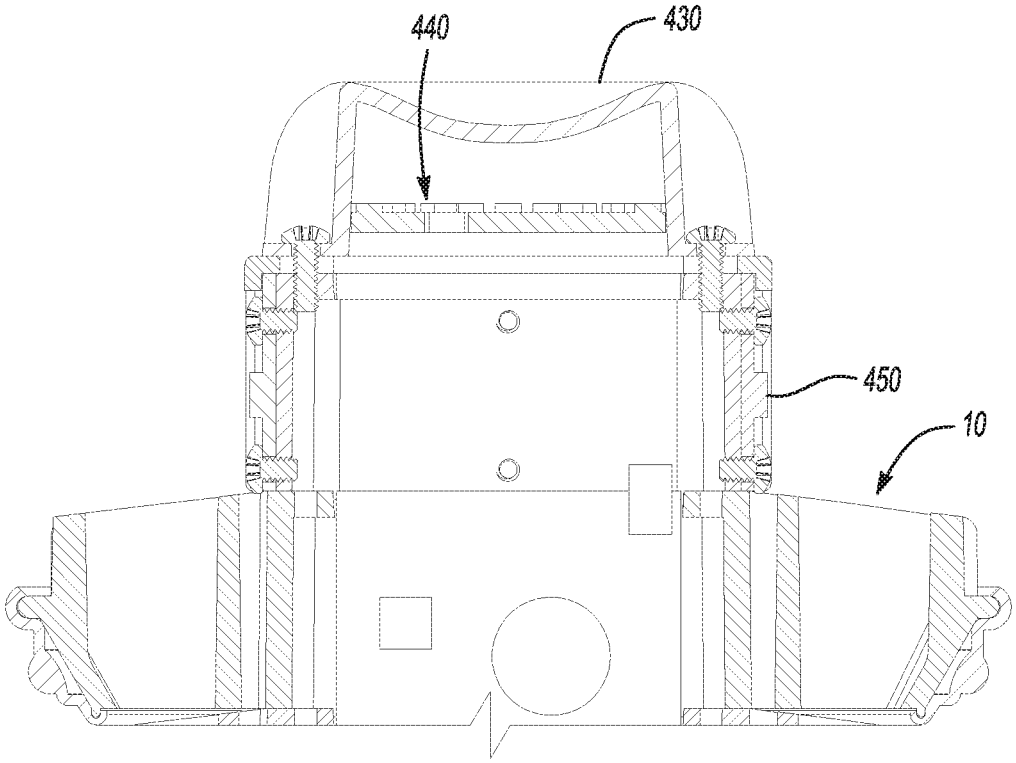
FIG. 23 depicts a cross sectional side view of an alternative embodiment uplight cap having RGBW lighting capability according to one or more embodiments shown and described herein.

FIGS. 21-23 depict an alternative embodiment RGBW cap for use with any of the aforementioned or forgoing LED light assemblies. The subassembly 400 includes a cover cap portion 430 configured to cover the plurality of LEDs 440 whereas other LEDs may be left exposed. It should be noted that the cap portion 430 is optional. Furthermore, a plurality of side positioned LEDs 450 are positioned on the sidewalls. This alternative RGBW cap is configured to shine light (either color or white) in an upward and/or side direction so as to illuminate a portion of a globe that the LED light assembly is placed in. The subassembly 400 has the capability to add color to a lamp assembly already only providing white light. Alternatively, only a portion of the lighting assembly may be illuminated in a color where the other portion of the light is illuminated in white. Alternatively, the entire globe or fixture may be illuminated a specific color.

Figure 24:
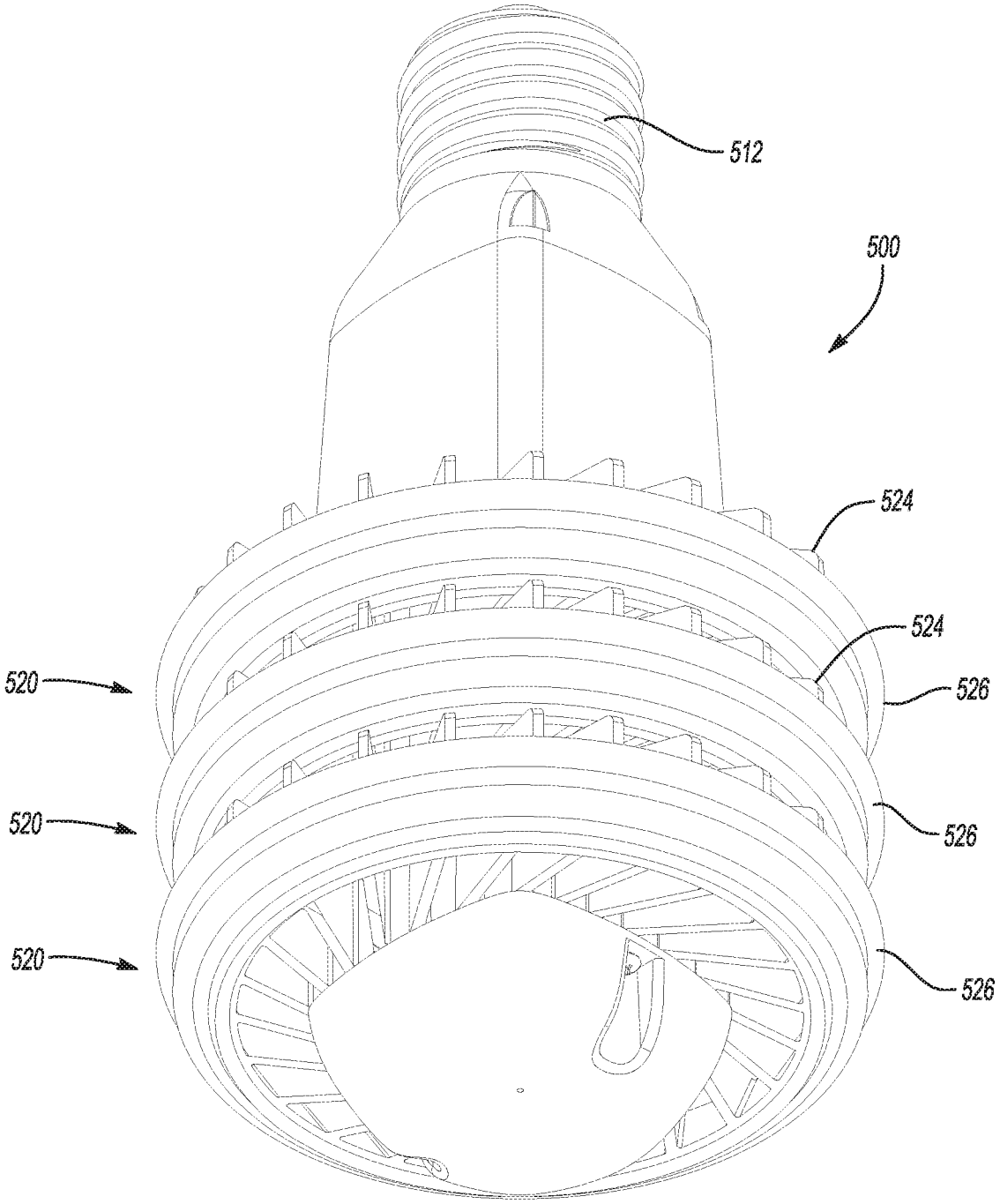
FIG. 24 depicts perspective view of an alternative base up model of the LED light assembly according to one or more embodiments shown and described herein.
Figure 26:
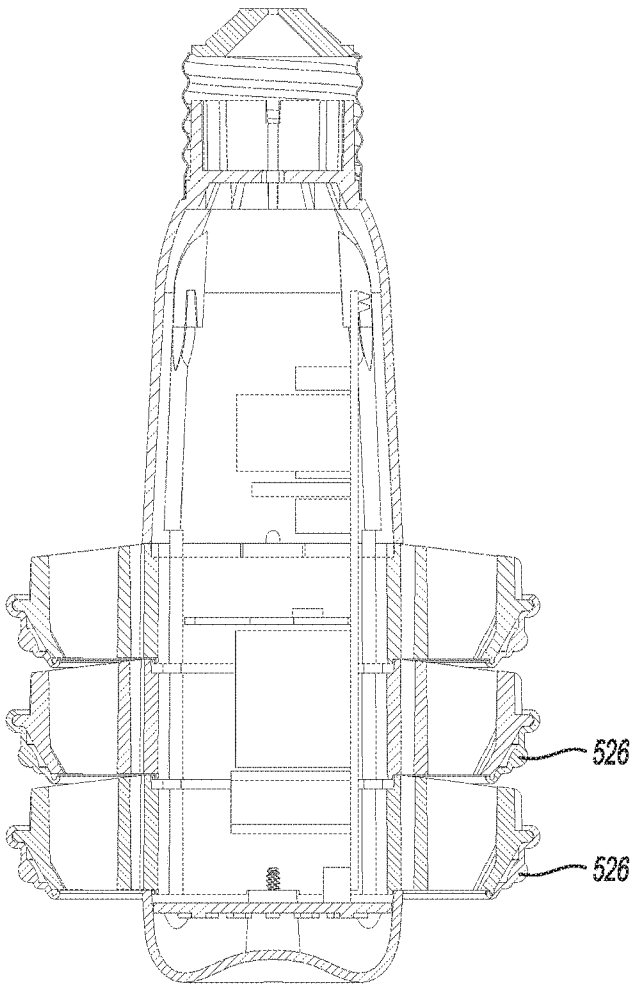
FIG. 26 depicts cross sectional view of an alternative base up model of the LED light assembly according to one or more embodiments shown and described herein.
Figure 25:
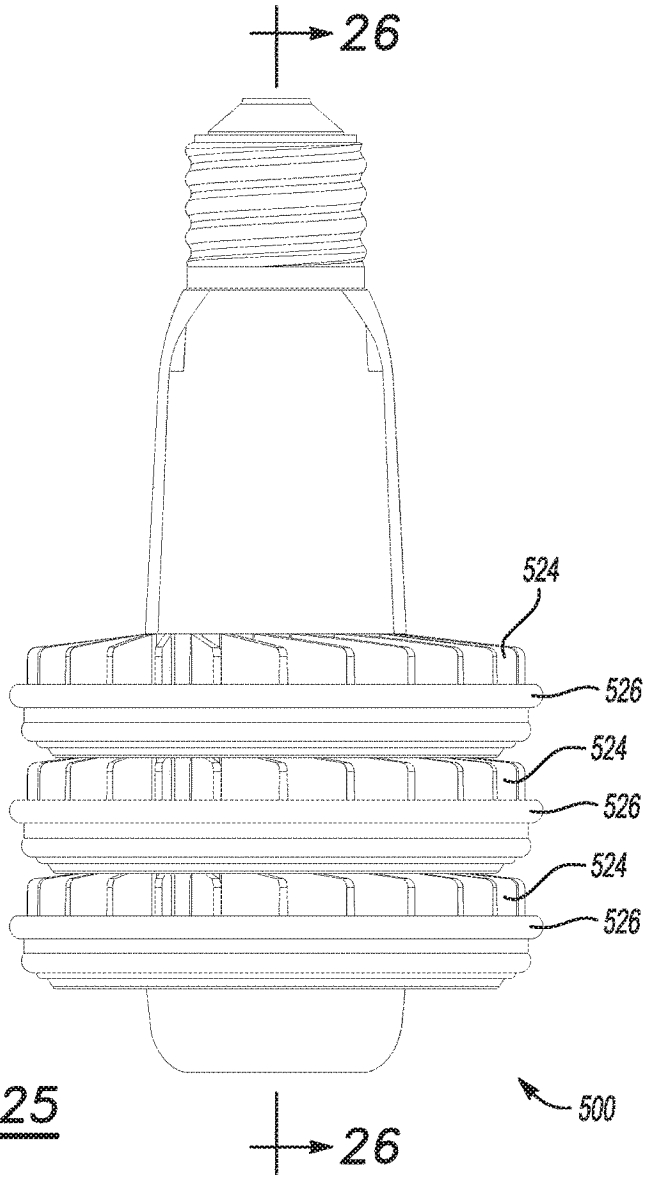
FIG. 25 depicts side view of an alternative base up model of the LED light assembly according to one or more embodiments shown and described herein.

FIGS. 24-26 depict an alternative "base up" model of an LED lighting assembly. This configuration may be applied to any of the aforementioned LED lighting assemblies as shown and described herein. In these embodiments, the optic 526 is flipped so as to properly direct the light downward in the case where the LED lighting assembly is in an upside-down position. A heat sink 524 and light rings 520 are also provided in a flipped configuration.

The LED light assemblies as mentioned above (10, 100, 200, 300 or any other assembly as mentioned herein) may be configured to mesh and network with other similar LED light assemblies. For example, the controller for the light assembly 10 may be connected to other LED light assemblies over a communication network, such as a wired Ethernet, WiFi, Bluetooth, RFID, or other known wired or wireless networks. The network may allow communication between controllers of each LED light assembly. The controllers of each assembly may then be synchronized to allow changes to one LED light assembly 10 to be replicated in all other assemblies on the network. For example, a series of street lamps along a street may all be synchronized such that each street lamp dims or shuts off specified light assembly groupings as desired. Individual controllers or light assemblies may also be removed from the mesh network, if desired, and tuned separately to provide customized solutions where needed. The control can occur from a mobile device and/or mobile application allowing a user to control single or multiple lamps, including turning off only portions of the plurality of lighting elements in each LED light assembly. Systems can be controlled to connect and communicate with a user device so when a user drives or moves within proximity various LED light assemblies installed in a street, the LED light assemblies are configured to turn on, turn off, or take some other action as dictated by the user.

Similarly, the lights may be configured to turn off (or on) only portions of the plurality of lighting elements on each ring of the LED light assemblies. By way of example, the LED light assemblies may be controlled to turn off the back lighting elements so as not to shine on a residential area (which is traditionally achieved by a physical blocker or barrier). Accordingly, in the present invention, the mapping (or distribution) of the light in each LED light assembly is capable of being controlled by designating a predetermined portion of the lighting elements of each ring so as to control and dictate the map of projection.

The assembly as described herein provided the advantage of auto commissioning or rapid commissioning of controls within screw based lamp, fixed plate lamp, or other luminaire light source. Lamp design, such that light source, is sized and located to fit within luminaire focus or focal point thereby maximizing the light performance of the system is also an advantage over the prior art and is shown herein. Options such as drive by and walk by lamp updates/communication—control system designed to update lamps and luminaires it communicates with by proximity as the control device is moved within range of individual devices (auto update or auto communicate) are also advantages over the prior art. The assembly as provided herein provides a light source with the ability to dim, control, or shut off the back light of the light source ('house side' part of the light distribution) thereby demonstrating significant advantages over the prior art. Furthermore, it should be noted that "remotely" means control at any position spaced apart from the assembly itself and may be achieved by computer, mobile device, mobile application . . . etc.

Various advantages are discussed in the forgoing to demonstrate advantages over the prior art. The disclosed LED light assemblies of the present specification are particularly advantageous in that in some embodiments, it is a screw in assembly allowing for ease of installing. Other advantages include Bluetooth® control allowing for easy and secure control at a distance, changing backlight, dim features and uplighting. Mesh controls, wherein the lighting assemblies are permitted to communicate with each other or with a central device, to allow for mesh network control with diagnostics is provided to improve operation of a plurality of assemblies. RGB and RGBW control allows for changing of color with or without shutting off of white lights. Other advantages include about 50% lower cost to operate as compared to corn cobs (not including controls savings), ease in installing (simply screw base & fixed plate), 3-5 times the light coverage of the competition LED with LESS glare, improved reliability (100,000 Hour Life (MTBF >400,000 hours), engineered silicone optics plus thermal protection properties (without the requirement of fans).

Other advantages include control on the same light including a Bluetooth version capable of functioning as a mesh unit with simple software update (over the air update) and one standard light can be used either as just Bluetooth or as Mesh. Control methods may include the ability to direct control using smart phone (within Bluetooth radio range) range and/or mesh control using low infrastructure low investment with control from anywhere (multi layer security, access by invite, MAC ID, Password, and Web security protocols).

Bluetooth functions include: smart phone communication using a mobile application (requires light is energized), the ability to connect with a single light and modify settings, turn light on or off, turn uplight on or off, dim main white light, set or modify astronomical dimming schedules, turn off backlight (option), set color of RGB or RGBW uplight (option), obtain diagnostics report, review key system parameters (burn time, temperature, etc), and/or set or review asset tag ID.

Further, two methods of control are provided: 1) smart phone control which requires lights are energized and/or, 2) smart phone or Windows based control (24/7 system access with secure gateway). Mesh functions include: connect with a single light and modify settings, or sync across system, Connect with a single light and modify settings, or 'lock' light to prevent mods, turn light on or off, turn uplight on or off, dim main white light, set or modify AstroDIM dimming schedules, turn off backlight (option), set color of RGB or RGBW uplight (option), obtain diagnostics report, review key system parameters (burn time, temperature, etc), and/or Set or review asset tag ID.

Figure 27:
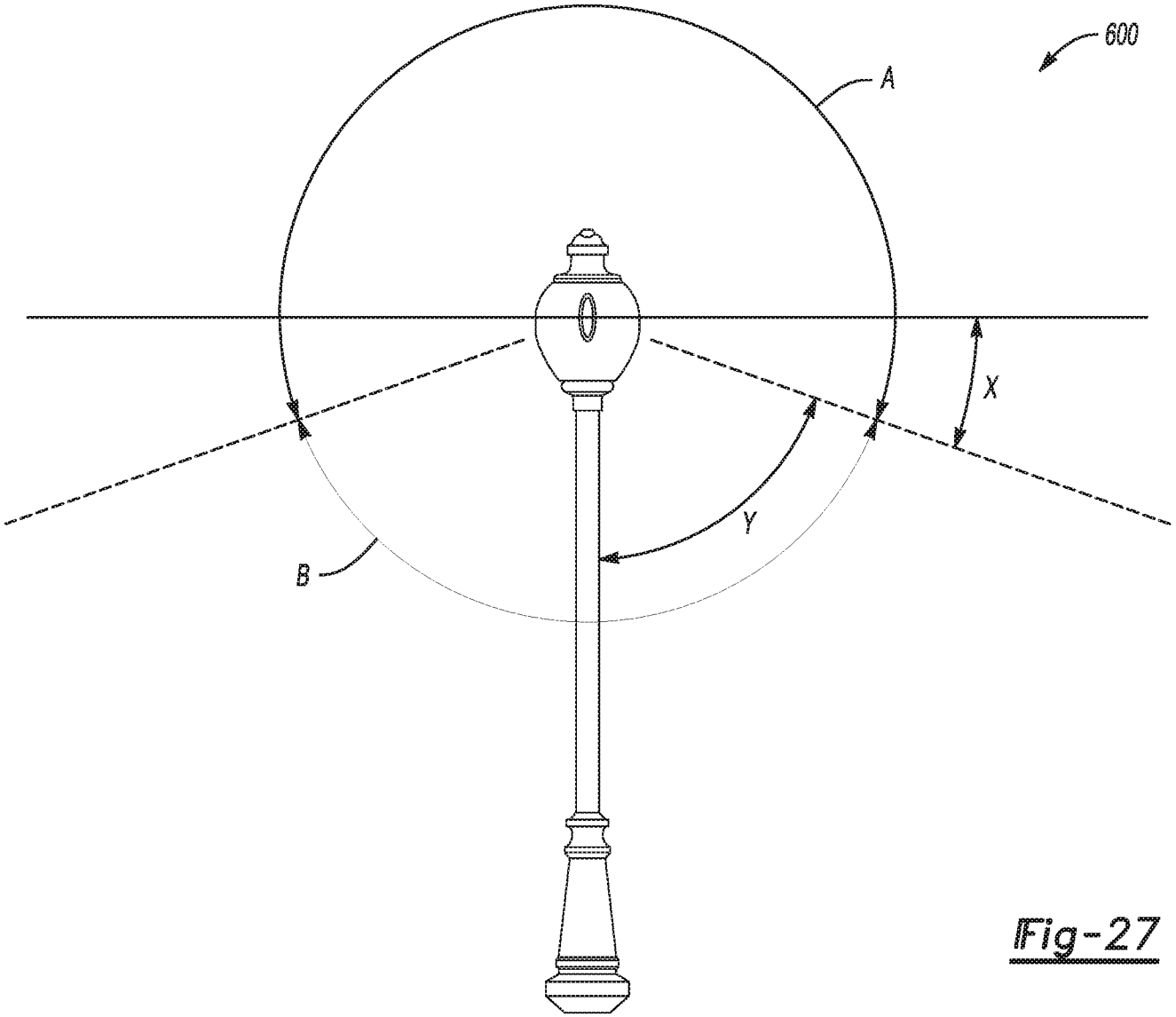
FIG. 27 depicts a graphical representation of the light lighting assemblies as mentioned herein according to one or more embodiments shown and described herein.

Furthermore, the structure as illustrated in the aforementioned figures provides the benefits to lighting as shown in FIGS. 27-31. FIG. 27 depicts the basic specifications and improvements of the aforementioned LED light assemblies. Uplight and waste is shown in at A and the performance area is shown at B, wherein X is approximately 20° and Y is approximately 70°. The specification compliant light source will emit light without reduced waste, produces more uniform illumination, have minimal uplight or glare, be IES compliant, be dark skies compliant and qualify for energy rebate approval.

Figure 28:
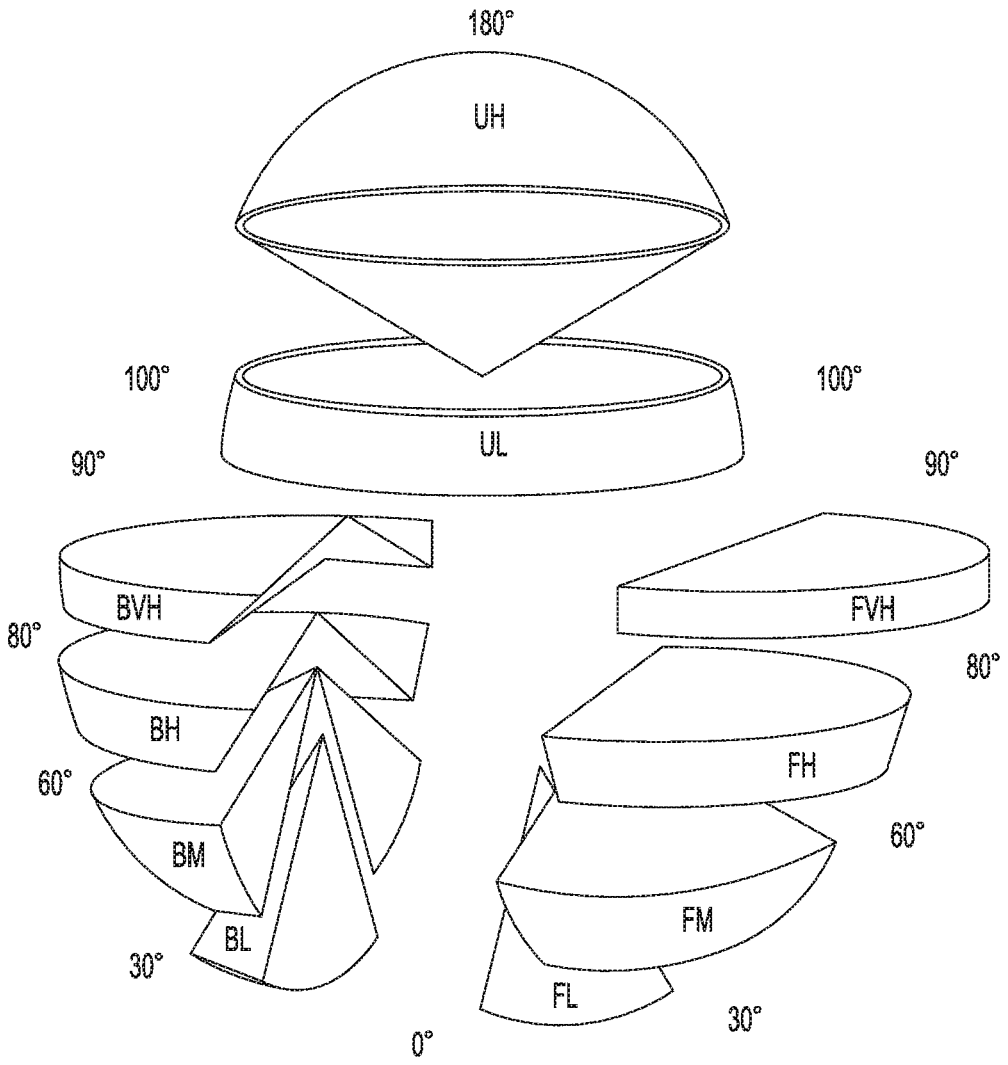
FIG. 28 depicts a graphical representation of unwanted and wanted light according to one or more embodiments shown and described herein.

FIG. 28 depicts the standard BUG rating system wherein all light assemblies of the present specification improve the BUG standard as shown in FIG. 28. BUG stands for Backlight ("B"), Uplight ("U"), Glare ("G").

Backlight, which can create light trespass onto adjacent sites, takes into account the amount of light in the BL, BM, BH and BVH zones, which are direction of the luminaire OPPOSITE from the area intended to be lighted.

Uplight causes artificial sky glow. Lower uplight (zone UL) causes the most sky glow and negatively affects professional and academic astronomy. Upper uplight (UH) is mostly energy waste. The U rating accounts the amount of light into the upper hemisphere with greater concern for the lower uplight angles in UL.

Lastly, Glare, which can be annoying or visually disabling. The G rating takes into account the amount of frontlight in the FH and FVH zones as well as BH and BVH zones. The lighting assemblies of the present specification improve on the BUG rating in all areas.

Figure 29:
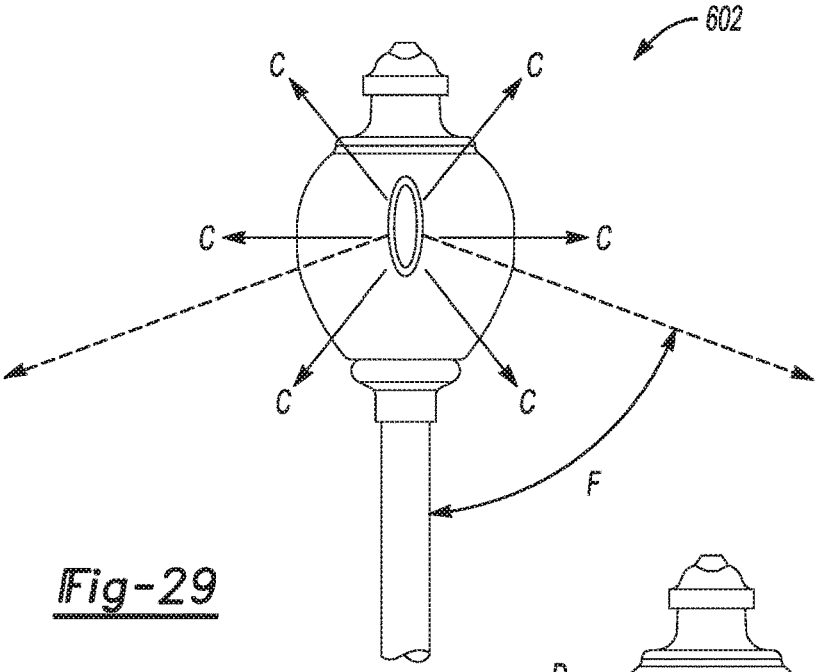
FIG. 29 depicts a standard bulb and corresponding wasted light according to one or more embodiments shown and described herein.
Figure 30:
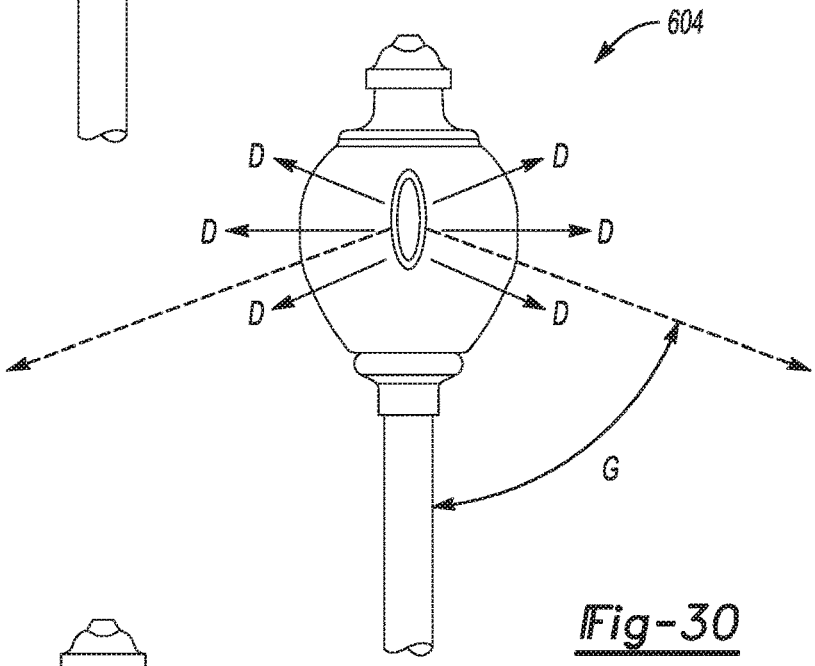
FIG. 30 depicts a corncob bulb and corresponding wasted light according to one or more embodiments shown and described herein.
Figure 31:
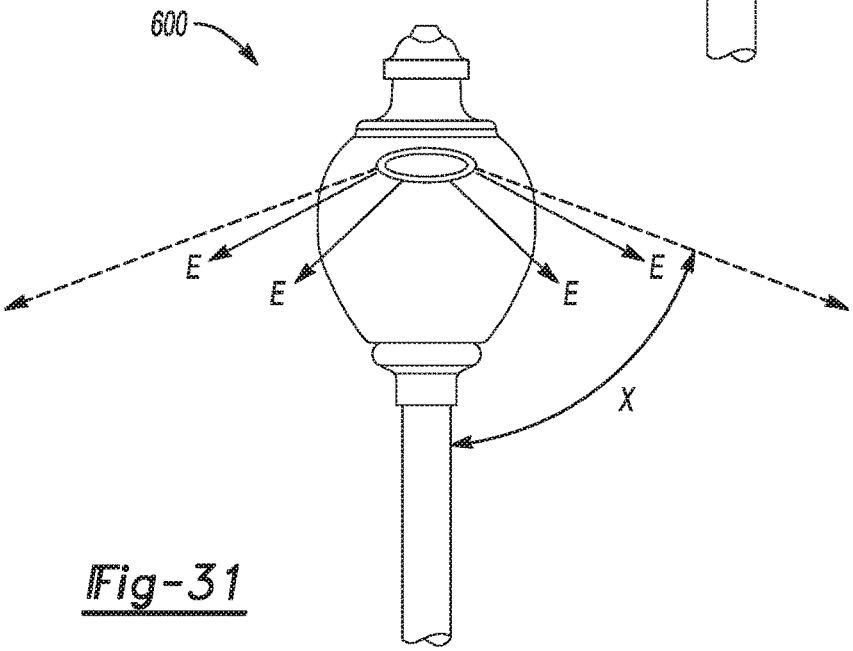
FIG. 31 depicts an ideal bulb as disclosed herein according to one or more embodiments shown and described herein.

FIGS. 29 and 30 depicts traditional and corncob style lights, respectively. In FIG. 28, the traditional bulb emits light at 360° as shown by C. F is 70°. Similarly, in the corncob as shown in FIG. 30, much of light D is emitted horizontally and is wasted. G is also 70°. The ideal bulb, the bulb of the present specification, is illustrated in FIG. 31, wherein E is the light that is directed downward, and X is 70°. In this configuration, little to no light is wasted.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

Having thus described the invention, I claim:

1. An LED lighting assembly comprising:

a housing having a top portion and an opposed base;

a plurality of lighting elements connected to and positioned radially around the assembly, at least one of the plurality of lighting elements directly connected to an integral heat sink;

each of the plurality of lighting elements positioned adjacent to an optic, the optic positioned radially over an outer portion of the lighting elements allowing light to pass through the optic to disperse light emitted from the lighting elements, the optic extending in a circular manner around the entirety of the exterior circumference of the lighting elements, the optic configured to control the direction of the light such that it directs the light below horizon to improve the area lighting efficiency.

2. The LED lighting assembly of claim 1 wherein the assembly includes a screw base so as to easily retrofit with existing lamp structures.

3. The LED lighting assembly of claim 1 wherein an auxiliary base is provided to connect to an existing lamp structure to accommodate the LED lighting assembly.

4. The LED lighting assembly of claim 1 wherein each of the plurality of lighting elements is an LED.

5. The LED lighting assembly of claim 1 wherein the assembly includes a processor in communication with a control device.

6. The LED lighting assembly of claim 5 wherein each of the plurality of lighting elements is independently controlled by the control device and the processor so as to enable a user to control only a portion of the plurality of lighting elements.

7. The LED lighting assembly of claim 5 wherein each of the plurality of lighting elements is controlled in subsets or groups of the larger population of the plurality of lighting elements by the control device and the processor so as to enable a user to control all or a portion of the plurality of lighting elements.

8. The LED lighting assembly of claim 5 wherein software is provided on the processor wherein the lighting assembly is configured to be updatable remotely.

9. The LED lighting assembly of claim 5 wherein the control device is a computer.

10. The LED lighting assembly of claim 5 wherein the control device is a mobile device.

11. The LED lighting assembly of claim 1 wherein the optic is positioned at least partially downward so as to direct light from the plurality of lighting elements in a downward direction with peak intensity in the 10 degrees below horizon to 40 degrees below horizon range.

12. The LED lighting assembly of claim 1 wherein an uplight subassembly is provided, the uplight subassembly having a separate light emitter separate from the lighting elements, the uplight subassembly connected to the LED lighting assembly.

13. The LED lighting assembly of claim 12 wherein the uplight subassembly can be controlled remotely.

14. The LED lighting assembly of claim 12 wherein the uplight subassembly includes RGB or RGBW light capability so as to illuminate a portion of the surrounding fixture with color.

15. The LED lighting assembly of claim 14 wherein the RGB or RGBW light can be operated with the white lights on or with the white lights off.

16. The LED lighting assembly of claim 14 wherein the RGB or RGBW light operates as a notification signal.

17. The LED lighting assembly of claim 1 wherein the LED lighting assembly is in communication with at least a second LED lighting assembly.

18. The LED lighting assembly of claim 1 wherein the LED lighting assembly is in communication with a central external control device.

19. The LED lighting assembly of claim 1 wherein a removeable and or replaceable cap subassembly is provided so as to enable a user to update and or change hardware.

20. An LED lighting assembly of claim 1 wherein a photocell receptacle is connected to and communicates with the LED lighting assembly to enable external control.

21. An LED lighting assembly of claim 1 wherein device control or updates can be accomplished automatically when the control device equipment passes within the communication distance of a Bluetooth radio to the LED lighting assembly.

* * * * *